US011857857B2

(12) United States Patent
Hurwitz

(10) Patent No.: US 11,857,857 B2
(45) Date of Patent: Jan. 2, 2024

(54) PORTABLE MARKER FOR ICE HOCKEY

(71) Applicant: Paul Hurwitz, Walpole, NH (US)

(72) Inventor: Paul Hurwitz, Walpole, NH (US)

( * ) Notice: Subject to any disclaimer, the term of this patent is extended or adjusted under 35 U.S.C. 154(b) by 210 days.

(21) Appl. No.: 17/295,273

(22) PCT Filed: Dec. 2, 2019

(86) PCT No.: PCT/US2019/064003
§ 371 (c)(1),
(2) Date: May 19, 2021

(87) PCT Pub. No.: WO2020/117671
PCT Pub. Date: Jun. 11, 2020

(65) Prior Publication Data

US 2021/0322845 A1 Oct. 21, 2021

Related U.S. Application Data

(60) Provisional application No. 62/834,446, filed on Apr. 16, 2019, provisional application No. 62/775,292, filed on Dec. 4, 2018.

(51) Int. Cl.

| | |
|---|---|
| ***A63B 69/00*** | (2006.01) |
| ***A63B 71/02*** | (2006.01) |
| ***A63B 71/00*** | (2006.01) |

(52) U.S. Cl.
CPC ..... *A63B 69/0026* (2013.01); *A63B 71/0036* (2013.01); *A63B 71/03* (2020.08); *A63B 2209/08* (2013.01); *A63B 2209/10* (2013.01); *A63B 2214/00* (2020.08); *A63B 2244/18* (2013.01)

(58) Field of Classification Search
CPC . A63B 69/0026; A63B 71/03; A63B 71/0036; A63B 2214/00
USPC ..... 473/446
See application file for complete search history.

(56) References Cited

U.S. PATENT DOCUMENTS

| | | | |
|---|---|---|---|
| 2,333,273 | A | 11/1943 | Scanlon |
| 2,762,327 | A | 9/1956 | Weig |
| 2,954,005 | A | 9/1960 | Cioffi et al. |
| 3,916,816 | A | 11/1975 | Fitch |
| 3,952,690 | A | 4/1976 | Rizzo et al. |
| 5,115,343 | A | 5/1992 | Bennett |

(Continued)

FOREIGN PATENT DOCUMENTS

GB 2156409 A 10/1985

OTHER PUBLICATIONS

"Hockeyshot", Edge Adapt Cone, hockeyshot.com, Jan. 25, 2021, "https://www.hockeyshot.com/collections/hockey-stickhandling-danglers/products/edge-adapt-cone.com",see Description & Figures.

(Continued)

*Primary Examiner* — Mitra Aryanpour
(74) *Attorney, Agent, or Firm* — GORDON & JACOBSON, P.C.

(57) ABSTRACT

Portable markers for sports such as ice hockey. The portable markers have a short profile, are stackable, have a bottom surface with enhanced friction to prevent movement of the markers on the ice, and define an opening through which the toe of a hockey stick blade may be inserted so that the markers may be easily placed upon and lifted from the ice and transported together on the hockey stick.

14 Claims, 16 Drawing Sheets

(56) References Cited

U.S. PATENT DOCUMENTS

| | | | | |
|---|---|---|---|---|
| 5,174,567 | A * | 12/1992 | Nordstrom | A63B 69/0024 473/446 |
| 5,294,113 | A * | 3/1994 | Ladouceur | A63B 59/70 473/563 |
| 5,375,553 | A | 12/1994 | Chen | |
| 5,566,638 | A | 10/1996 | Rokosny | |
| 5,613,798 | A | 3/1997 | Braverman | |
| 6,102,611 | A | 8/2000 | Roller | |
| 6,506,123 | B1 | 1/2003 | Weidlich | |
| 6,971,329 | B1 | 12/2005 | Stewart | |
| 10,532,260 | B2 * | 1/2020 | Del Monte | A63B 69/0026 473/446 |
| 2004/0159280 | A1 | 8/2004 | Mohelsky et al. | |
| 2006/0266274 | A1 | 11/2006 | Kuo | |
| 2017/0361190 | A1 | 12/2017 | Del Monte | |
| 2019/0366180 | A1 | 12/2019 | Waffensmith | |
| 2019/0388757 | A1 * | 12/2019 | Francken | A63B 59/70 473/446 |
| 2021/0322845 | A1 * | 10/2021 | Hurwitz | A63B 71/0036 473/446 |

OTHER PUBLICATIONS

PCT International Search Report and Written Opinion dated Apr. 1, 2020 of application No. PCT/US 19/64003.
PCT International Preliminary Report on Palatability dated Feb. 10, 2021 of application No. PCT/US2019/064003.

* cited by examiner

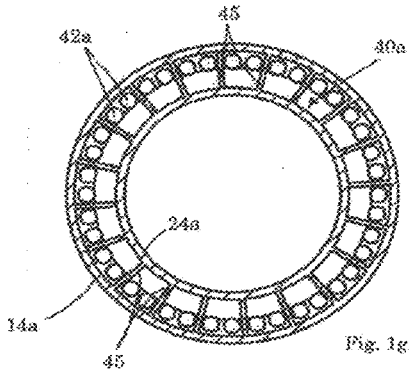
Fig. 1g
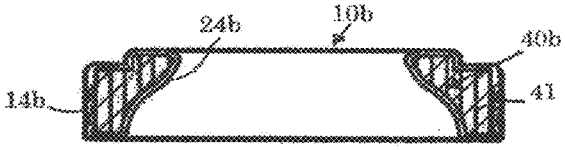
Fig. 1h
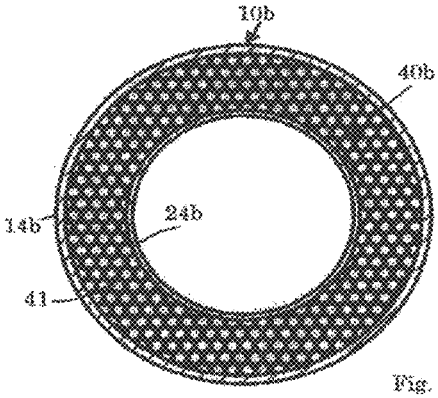
Fig. 1i
Fig. 2a
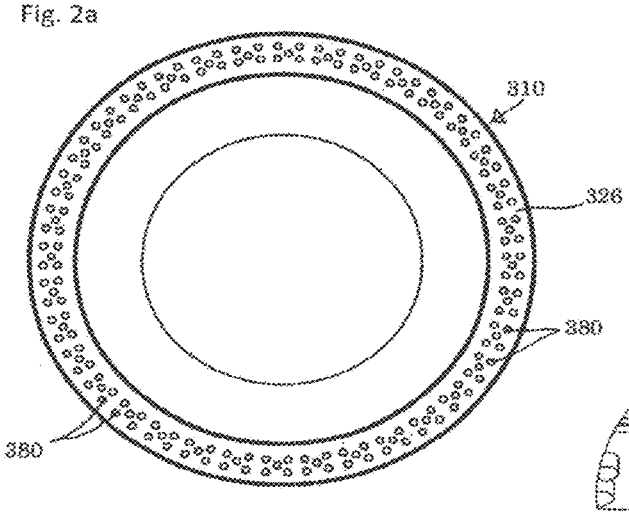
Fig. 3
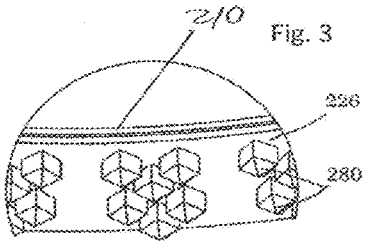
Fig. 2b
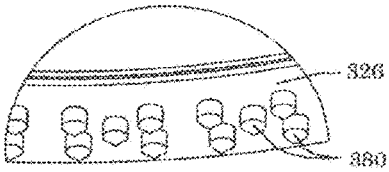
Fig. 4
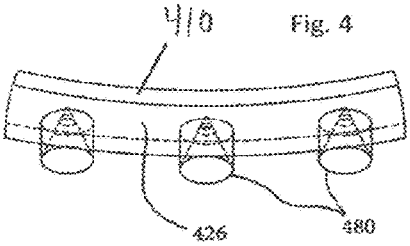

Fig. 5
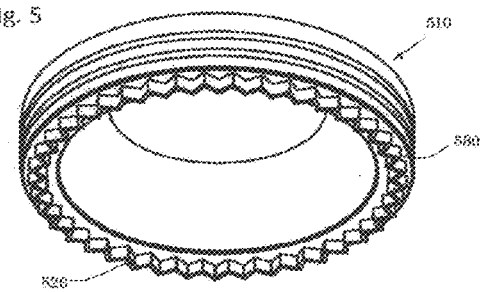
Fig. 6
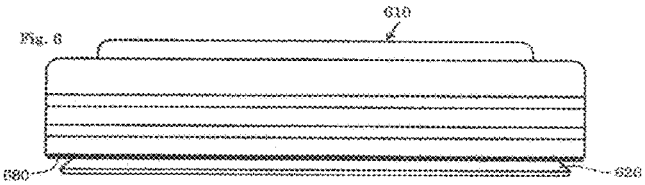
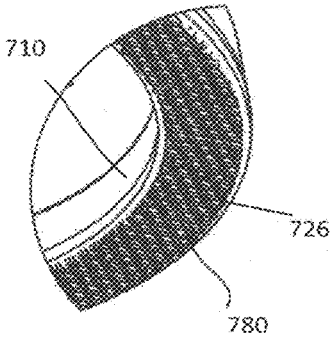
Fig. 7
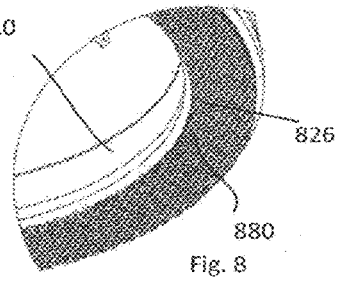
Fig. 8
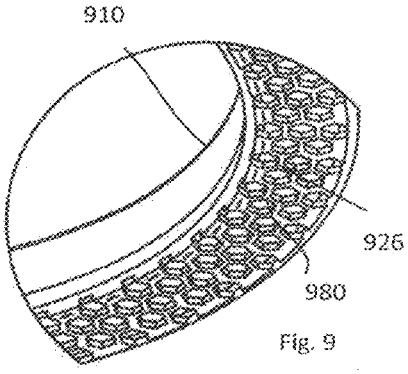
Fig. 9
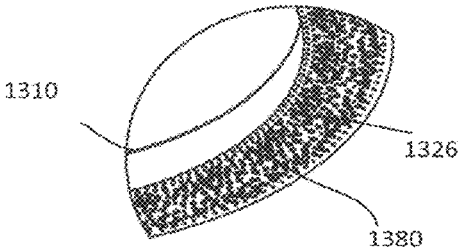
Fig. 11
Fig. 10
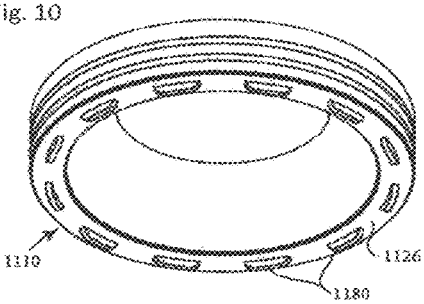
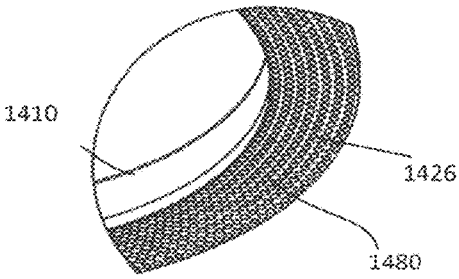
Fig. 12

Fig. 24a
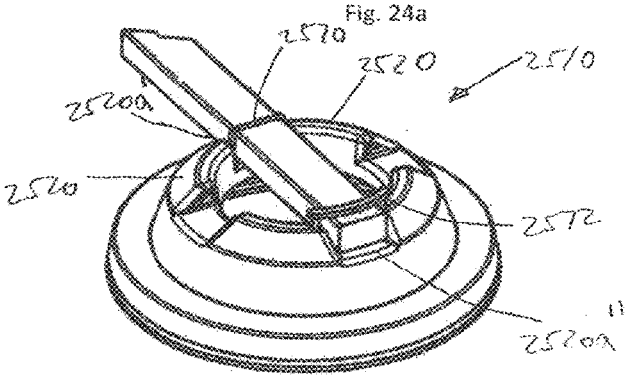
Fig. 24b
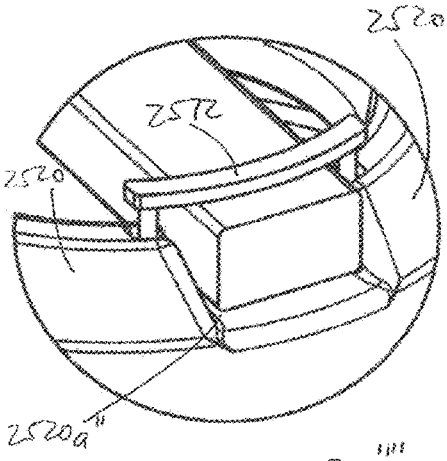
Fig. 24c
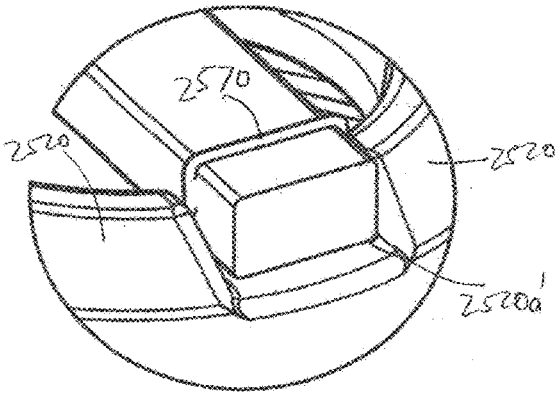
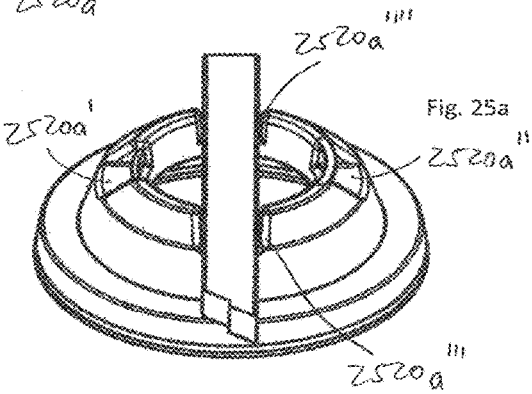
Fig. 25a
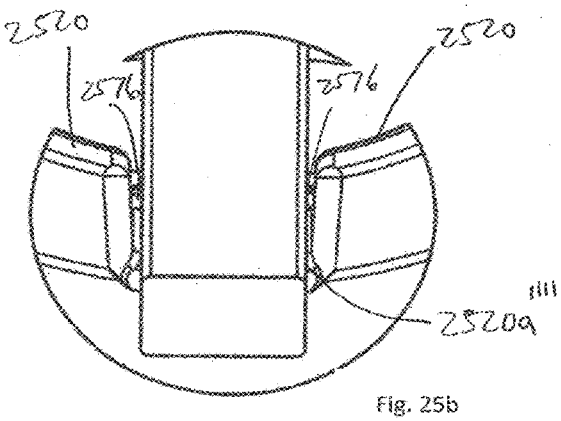
Fig. 25b
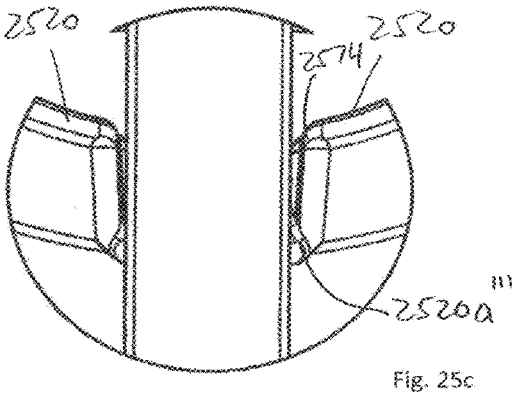
Fig. 25c

PORTABLE MARKER FOR ICE HOCKEY

CROSS-REFERENCE TO RELATED APPLICATIONS

This application is the National Stage of International Patent Application No. PCT/US2019/064003 filed on Dec. 2, 2019, which claims priority to U.S. Provisional Application No. 62/775,292, filed on Dec. 4, 2018 and to U.S. Provisional Application No. 62/834,446, filed on Apr. 16, 2019, the entire contents of both of which are incorporated by reference herein.

BACKGROUND

1. Field

The present disclosure is directed to accessories for sporting activities. More particularly, the present disclosure is directed to portable markers for use on surfaces with low static and dynamic coefficients, such as ice.

2. State of the Art

Portable markers commonly used for sporting activities on ice, such as skating and hockey training markers, are often safety cones primarily intended for automotive traffic signaling Some traffic safety cones are modified to reduce overall size and/or to add weight to the base of the cone. These modifications are intended to mitigate lateral displacement and upending of the cones from their prearranged locations on the ice which result from impact by skaters or projectiles (e.g., hockey pucks). Despite the modifications, the marker cones of the art still require frequent repositioning and righting during use. Such repositioning and righting of cones during use disrupts the activity in progress, requires labor, and consumes valuable "ice time".

The process of placing cones upon and removing cones from the ice surface is cumbersome and time consuming. Cones are typically stored in nesting fashion to form a stack that is unwieldy to transport. Separation of stacked cones, one from another, often requires the use of two hands due to static electricity and/or frictional adhesion formed between proximate conical surfaces. Both the placement and the removal of individual cones from the ice surface onto or from a stack typically requires the user (e.g., a coach) to bend forward to manipulate each cone by hand, which at a minimum is cumbersome while transporting a stack of cones. Furthermore, the processes of placing cones on the ice and moving or removing stacked cones from the ice often prohibits simultaneous transportation of a hockey stick. Accordingly, the user must spend additional time to retrieve a hockey stick before commencing with an activity.

SUMMARY

This summary is not intended to identify key or essential features of the claimed subject matter, nor is it intended to be used as an aid in limiting the scope of the claimed subject matter.

A portable marker for use in sporting activities such as skating and ice hockey is comprised of a durable, water-resistant material, able to withstand sub-freezing temperatures and has (i) an outer wall having a generally vertical lower area, a generally vertical upper area of smaller circumference than the lower area, a generally horizontal shoulder connecting the lower and upper areas of the wall, and a generally horizontal top surface defining a top opening of the marker, (ii) an inner wall extending from the generally horizontal top surface and spaced from at least a portion of the outer peripheral wall, and (iii) a bottom friction surface. The inner wall and/or the exterior surface of the outer wall define(s) an inner hollow that may receive the toe of a hockey stick for purposes of manipulation of the marker, while at least the lower area of the outer wall helps define a second hollow that may be filled with or provided with ballast. The second hollow may be divided by interior walls into compartments for the ballast. The bottom friction surface is sized similarly to the generally horizontal shoulder so that the portable marker may be stacked on another portable marker.

Another portable marker for use in sporting activities is comprised of a durable, water-resistant material having (i) an outer wall, (ii) an inner wall, (iii) a top surface extending from the outer wall to the inner wall, (iv) one or more upper wall elements extending from the top surface adapted for permitting another marker to be stacked on the portable marker; and (v) a bottom friction surface. The inner wall and/or the exterior surface of the outer wall define(s) an inner hollow that may receive the toe of a hockey stick for purposes of manipulation of the marker. The inner wall may have a portion that is concave for receiving the hockey stick toe. The inner wall and outer wall may be the inner and outer walls of a solid frustoconical body or a tapered body, or may be spaced from each other to define a second hollow that may be provided with ballast.

Another portable marker for use in sporting activities is comprised of a durable, water-resistant material, able to withstand sub-freezing temperatures having (i) an outer wall, (ii) an inner wall, (iii) a top surface extending from the outer wall to the inner wall, (iv) a bottom friction surface, and (v) an insert including at least a portion of a ring and having upper wall elements extending upward therefrom, where the top surface defines a receiving area that receives and engages the insert, and the ring engages the receiving area. The inner wall defines an inner hollow that may receive the toe of a hockey stick for purposes of manipulation of the marker. The inner wall and outer wall may be the inner and outer walls of a solid frustoconical body or a tapered body, or may be spaced from each other to define a second hollow that may be provided with ballast. The portable marker may be stacked on another portable marker by appropriately locating the upper wall elements and shaping the marker body.

In embodiments where an insert is provided that engages an upper wall of the marker, the insert may be snap-fit into the receiving area of the upper wall. The insert may be provided with live hinges or similar elements that permit a portion of the insert to be lifted off the upper wall to provide direction indications. The insert may be provided with integrated direction arrows. The insert, or a portion thereof may be transparent to serve as a window covering text or graphics inserted beneath the insert and on top of the upper wall.

In embodiments, the portable marker weighs between 0.75 and 1.5 pounds. In embodiments, the portable marker is between 1 inch and 8 inches tall, or between 1.5 inches and 3 inches tall. In embodiments, a stack of six markers is less than forty-eight inches tall. In embodiments, a stack of six markers is less than twenty inches tall. In embodiments, the portable marker has an outside diameter of between 6 and 12 inches, and the top opening defined by the top surface of the marker is at least 2.5 inches in diameter.

In embodiments, the bottom friction surface is formed from an abrasive material, or an abrasive surface texture, or an adhesive-backed safety tread, or a steel mesh, or one or a series of vertically-oriented points, blades, or edges that engage the surface of the ice, or a textile, or a perforated steel sheet, or other materials or arrangements. In embodiments, the bottom friction surface assumes a ring-shaped arrangement.

In embodiments, the friction surface may be formed by molding or machining or additive manufacturing an abrasive texture or one or a plurality of vertically oriented points, angled blades or edges that engage the surface of the ice in to the bottom wall of the device. In embodiments, the abrasive material, vertically oriented points, angled blades or edges that engage the ice surface are embedded into the bottom wall of the device.

In embodiments, the portable marker will not be laterally displaced when located on ice and subjected to an external force of 2 newtons applied along a horizontal radial axis towards the center of the marker, halfway up the outer peripheral wall at the corresponding point of tangency.

BRIEF DESCRIPTION OF THE DRAWINGS

FIG. 1*g* is a cross sectional view of an alternative embodiment of a marker having compartments for ballast.

FIGS. 1*h* and 1*i* are cross-sectional views of an alternative embodiment of a marker where the inner hollow is at least partially filled with a cellular structure.

FIGS. 2*a* and 2*b* are diagrams of an embodiment of a bottom surface of a portable marker having vertical conical points.

FIG. 3 is a diagram of another embodiment of a bottom surface of a portable marker having vertical pyramidal points.

FIG. 4 is a diagram of an embodiment of a bottom surface of a portable marker having inverse-conical blades.

FIG. 5 is a diagram of another embodiment of a bottom surface of a portable marker having a continuous serrated blade.

FIG. 6 is a diagram of another embodiment of a bottom surface of a portable marker having a continuous blade angled forty-five degrees to the ice surface.

FIG. 7 is a diagram of another embodiment of a bottom surface of a portable marker having steel mesh.

FIG. 8 is a diagram of another embodiment of a bottom surface of a portable marker having a textile thereon.

FIG. 9 is a diagram of another embodiment of a bottom surface of portable marker having perforated steel sheet.

FIG. 10 is a diagram of another embodiment of a bottom surface of a portable marker including a plurality of straight blades at ninety degrees to the ice surface.

FIG. 11 is a diagram of another embodiment of a bottom surface of a portable marker having an abrasive tread.

FIG. 12 is a diagram of another embodiment of a bottom surface of a portable marker having a rubber compound.

FIG. 24*a* is a top perspective view of another embodiment of a portable marker with means for securing an elevated shaft within four respective upper area notches and shown with a shaft secured within two upper area notches.

FIGS. 24*b* and 24*c* are detail views of the portable marker and shaft shown in FIG. 25*a*.

FIG. 25*a* shows the portable marker of FIG. 24*a* with a shaft secured within another two upper area notches.

FIGS. 25*b* and 25*c* are detailed views of the portable marker and shaft shown in FIG. 25*a*.

DETAILED DESCRIPTION OF EMBODIMENTS

Figure 1A:
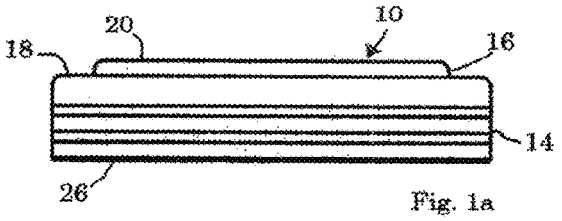
FIG. 1*a* is a side view of a first embodiment of a portable marker.
Figure 1B:
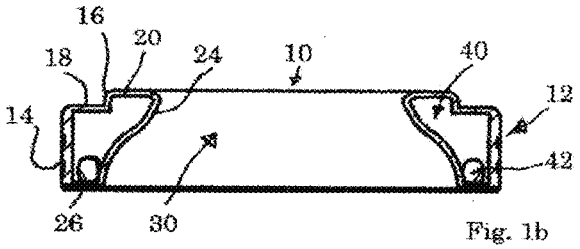
FIG. 1*b* is a cross-section through the portable marker of FIG. 1*a*.
Figure 1C:
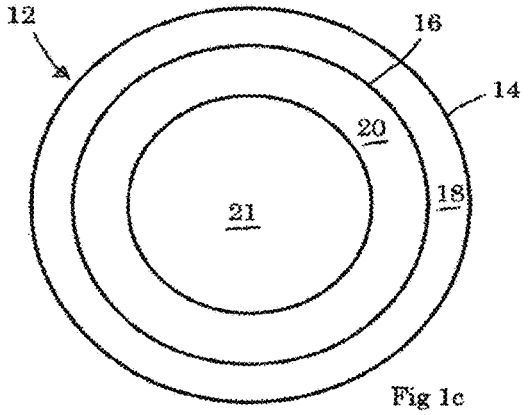
FIGS. 1*c* and 1*d* are top plan and top perspective views of the marker of FIG. 1*a*.
Figure 1D:
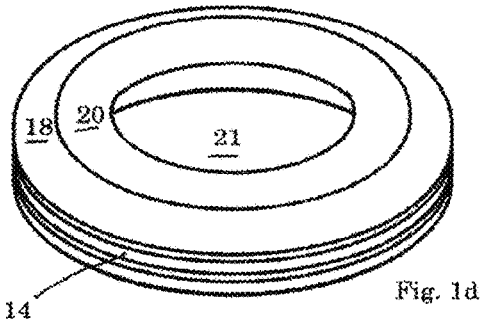
Figure 1E:
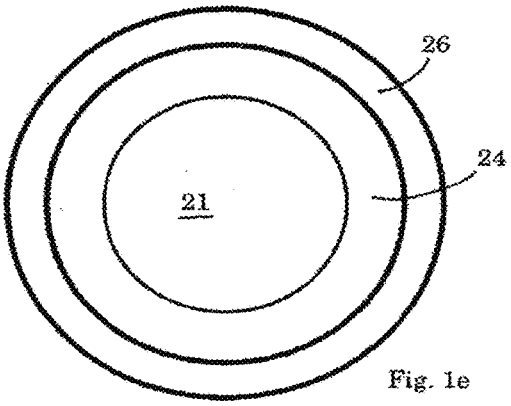
FIGS. 1*e* and 1*f* are bottom plan and bottom perspective views of the marker of FIG. 1*a*.
Figure 1F:
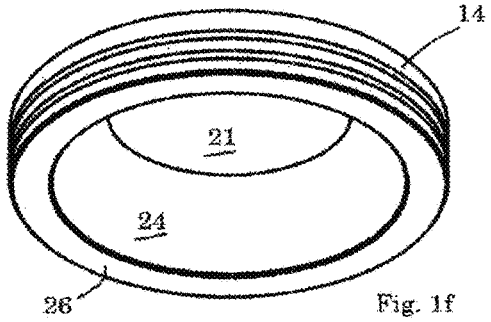

Turning to FIGS. 1*a*-1*f*, a portable marker 10, useful for sporting activities such as skating and ice hockey is seen. The marker 10 has an outer, stepped peripheral wall 12 having a generally vertical lower area 14, a generally vertical upper area 16 of smaller circumference than the lower area, a generally horizontal shoulder 18 connecting the lower and upper areas of the wall, and a generally horizontal top surface 20 defining a top opening 21 of the marker. For purposes herein, the term "generally vertical" shall be understood as being within twenty-five degrees of vertical. As seen best in FIGS. 1*b*, 1*d* and 1*f*, the marker 10 also has an inner wall 24 extending from the generally horizontal top surface 20 and spaced from the vertical upper area 16 and vertical lower area 14 of the outer peripheral wall 12. The marker 10 further includes a bottom wall 26 having a friction surface located between the bottom of the inner wall 24 and the bottom of the lower area 14 of the outer peripheral wall 12. The inner wall is shown angling in a concave fashion and defining an inner hollow 30 that may receive the toe of a hockey stick for purposes of manipulation of the marker (as described hereinafter with respect to FIGS. 13*a*-13*e*). The inner hollow 30 is shown as a modified frustoconical shape that presents a lower concave area and an upper area that is conical or slightly convex; which may also be called "plunger"-shaped. The inner wall 24, outer wall 12 and bottom wall 26 together define a second hollow 40 that are optionally provided with ballast 42 (seen in FIG. 1*b*). The second hollow 40 may be divided by interior walls (discussed with reference to FIG. 1*g*) into compartments for the ballast. In one aspect, the bottom wall may be shaped as a ring (disk with central hole), with a ring width similar to the width of the generally horizontal shoulder 18 of the outer peripheral wall 12 so that the portable marker 10 may be stacked on another portable marker.

In one embodiment, the bottom wall 26 is formed separately from the remainder of the portable marker and is glued, mechanically fitted or otherwise attached to the bottom surfaces of the peripheral wall 12 and the inner wall 24.

In one embodiment, the peripheral and inner walls of the portable marker 10 are comprised of a durable, water-resistant material able to withstand sub-freezing temperatures such as plastic, rubber, aluminum, or other suitable material. The bottom wall 26 may be formed of a different material than the peripheral and inner walls. In embodiments, the bottom wall 26 is formed of a more rigid material than the materials of the peripheral and inner walls. As will be discussed hereinafter with reference to FIGS. 2*a*-12, the bottom surface of the bottom wall 26 is provided with an enhanced friction surface. In addition, the bottom wall may be formed of a material that is substantially heavier than the material of the durable, water-resistant material of the body of the marker. In this manner, the bottom wall may itself act as a ballast.

In embodiments, the ballast comprises a separate ring of material such as metal. In other embodiments, the ballast comprises pellets of metal such as steel; e.g., metal shot, bearings or sinkers. Thus, as shown in an alternative embodiment of FIG. 1*g*, the second hollow or void 40*a* formed between the inner wall 24*a* and at least the lower vertical wall 14*a* is divided into compartments by a plurality of divider walls 45 running therebetween. The pellets 42*a* may be located in various compartments formed in the second hollow 40*a*. According to one aspect, the pellets 42*a* counteract lateral forces exerted upon the marker 10 and act as a shock-absorbing mechanism for the marker 10.

In embodiments, the ballast comprises pseudo-plastic fluid such as a carbomer gel. In embodiments, the ballast comprises sand or other granulated mineral. In embodiments, the ballast comprises a water-soluble material such as sodium chloride crystals. In embodiments, loose ballast in the form of solution, pellets, grains or crystals may be contained within a sealed sleeve of polyethylene or other plastic film tubing. In embodiments, the ballast comprises energy-absorbing foam such as cellular material. The ballast may shift in relation to the walls or surfaces of the marker 10. In one aspect, the ballast counteracts lateral forces exerted upon the marker and acts as a shock-absorbing mechanism for the marker.

In embodiments, such as seen in FIGS. 1*h* and 1*i*, a portable marker 10*b* may be substantially as shown in FIGS. 1*a*-1*f*, except that the inner hollow 40*b* between the inner wall 24*b* and the lower vertical wall 14*b* is at least partially filled with a geometric cellular formation such as a structural lattice 41. The lattice may be formed of the same material as the inner and outer walls of the portable marker and may take different formats. Alternatively, the cellular material forming the lattice 41 may be of a different material which may take a cellular lattice structure. Or, the material may be a foam. It is noted that the structure 41 may act as a shock-absorbing mechanism for the marker 10*b*.

In embodiments, the portable marker (including any ballast) weighs between three-quarters of a pound and two pounds. In embodiments, the portable marker (including any ballast) weighs between one and one and a half pounds.

In embodiments, the portable marker is between one inch and eight inches tall. In embodiments, the portable marker is between one-and-a-half inches and three inches tall. In embodiments, a stack of six markers is equal to or less than twenty inches tall. In other embodiments, a stack of six markers is equal to or less than forty-eight inches tall.

In embodiments, the height of the vertical lower area 14 of the peripheral wall is between two and five times the height of the vertical upper area 16 of the peripheral wall.

In embodiments, the vertical lower area 14 of the peripheral wall 12 of the portable marker 10 has an outside diameter of between six and twelve inches.

In embodiments, the vertical lower area 14 of the peripheral wall 12 of the portable marker 10 has an outside diameter between twelve and eighteen inches.

In embodiments, the top opening 21 defined by the top surface 20 of the marker 10 is at least two-and-a-half inches in diameter.

In embodiments, the bottom wall 26 is chamfered at its inside diameter to help facilitate insertion of a hockey stick blade toe between portable marker and the ice on which it sits.

In embodiments, the bottom wall 26 is chamfered at its outside diameter to help facilitate separation of individual markers from one another in a stack.

FIG. 3 is a diagram of an embodiment of a bottom surface 226 of a portable marker 210 having pyramidal points 280 extending therefrom. The pyramidal points are shown as extending from square bases and extending around the bottom surface 226. The pyramidal points may be formed from metal, plastic, or other material.

FIGS. 2*a* and 2*b* are diagrams of an embodiment of a bottom surface 326 of a portable marker 310 having conical points 380. The conical points are shown as extending from cylindrical bases and extending around the bottom surface. The conical points may be formed from metal, plastic, or other material.

FIG. 4 is a diagram of an embodiment of a bottom surface 426 of a portable marker 410 having inverse-conical blades 480. The inverse-conical blades have a cylindrical outer surface, and an inner surface that tapers so that the material is thicker where it joints the bottom surface 426 and thinner as it extends away therefrom. The inverse-conical blades may be formed from metal, plastic, or other material.

FIG. 5 is a diagram of another embodiment of a bottom surface 526 of a portable marker 510 having a continuous blade 580 angled ninety degrees (perpendicular) to the ice surface. The blade 580 has a serrated pattern that extends three-hundred sixty degrees around the bottom surface 526. The serrated blade may be formed from metal, plastic, or other material.

FIG. 6 is a diagram of another embodiment of a bottom surface 626 of a portable marker 610 having a continuous blade 680 angled forty-five degrees to the ice surface. The angled blade may be formed from metal, plastic, or other material.

FIG. 7 is a diagram of another embodiment of a bottom surface 726 of a portable marker 710 having steel mesh 780.

FIG. 8 is a diagram of another embodiment of a bottom surface 826 of a portable marker 810 having a textile 880. In embodiments, the textile fibers are impregnated with abrasive material such as aluminum oxide or other suitable material. In embodiments, the textile comprises polyolefin or other suitable materials such as may be used in automobile tire socks intended to improve traction on snow and ice. In embodiments, the textile may be a vinyl textile or other suitable wettable material capable of forming a frozen bond with the ice surface after wetting. The vinyl textile or other suitable material may be single ply or multiple ply and incorporate open cell foam or similar material capable of absorbing, retaining and expressing liquid (e.g., water).

FIG. 9 is a diagram of another embodiment of a bottom surface 926 of a portable marker 910 where the bottom surface comprises perforated steel sheet similar to such as may be used in a kitchen grating utensil.

FIG. 10 is a diagram of another embodiment of a bottom surface 1126 of a portable marker 1110 where the bottom surface includes a plurality of straight blades 1180 at ninety degrees (perpendicular) to the ice surface. Blades 1180 may be formed from metal, plastic, or other material.

FIG. 11 is a diagram of another embodiment of a bottom surface 1326 of a portable marker 1310 having an abrasive tread of surface 1380. The abrasive tread 1380 may be a suitable pressure sensitive anti-slip tread that is readily obtainable with a covered adhesive backing, such as 3M™ Safety-Walk™ 710 coarse tapes and treads. When the cover is taken off the adhesive backing, the adhesive backing is applied to the bottom surface 1326 of the marker 1310. In other embodiments, the abrasive tread may comprise epoxy, acrylic, rubber or other adhesives impregnated with silicon carbide, aluminum oxide, allyl diglycol carbonate or other suitable materials.

FIG. 12 is a diagram of another embodiment of a bottom surface 1426 of a portable marker 1410 having a traction-enhanced rubber compound element 1480 such as may be used on traction shoe outsoles for use on ice or in snow. The traction-enhanced rubber compound may contain abrasive particles such as walnut shell, silicon carbide, aluminum oxide, garnet and other materials.

As suggested by FIGS. 2*a*-12, in embodiments, the bottom friction surface may be formed in many different arrangements and from many different materials. The friction surface may be formed from an abrasive material, an adhesive-backed safety tread, or a steel mesh, a perforated steel sheet, a textile, a traction-enhanced rubber compound, or one or a series of vertically-oriented, or angled points, blades or edges that engage the surface or the ice, or other materials or arrangements. In embodiments, the bottom friction surface assumes a ring-shaped arrangement.

In embodiments, the portable marker will not be laterally displaced when located on ice and subjected to an external force of 2 newtons applied along a horizontal radial axis towards the center of the marker, halfway up the outer peripheral wall at the corresponding point of tangency.

Figure 13A:
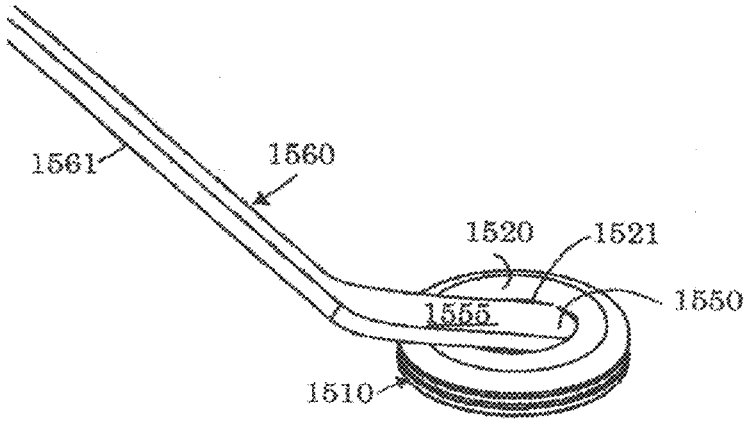
FIG. 13*a* is a perspective view of a hockey stick blade toe engaging the portable marker of FIG. 1*a*.
Figure 13B:
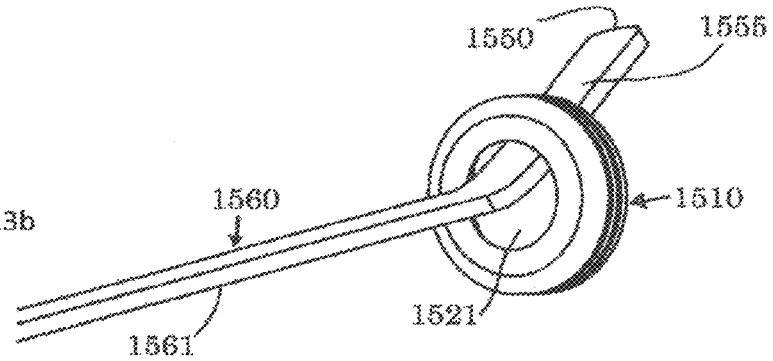
FIG. 13*b* is a perspective view of the portable marker of FIG. 1*a* being loaded onto the blade of a hockey stick.
Figure 13C:
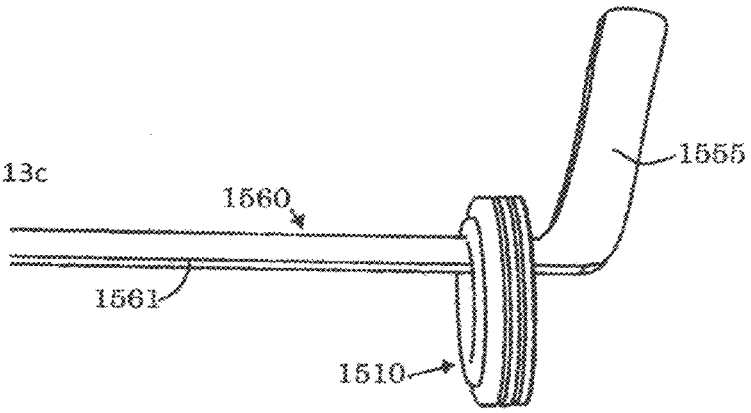
FIG. 13*c* is a perspective view of the portable marker of FIG. 1*a* being supported by a hockey stick.

Turning now to FIGS. 13*a*-13*c*, a method of lifting a portable marker from the ice with a hockey stick is illustrated. In FIG. 13*a*, a portable marker 1510 with a structure the same or similar to marker 10 of FIGS. 1*a*-1*f* (or FIG. 1*g*), and with a bottom friction surface such as shown in any of FIGS. 2*a*-12 is shown with the toe 1550 of a blade 1555 of a hockey stick 1560 shown extending through the top opening 1521 of the marker 1510 and engaging the edge or bottom surface of a top wall 1520, or the inner wall of the marker 1510. By torqueing the shaft 1561 (FIGS. 13*b* and 13*c*) of the hockey stick, the marker may be flipped along the blade 1555 and onto the shaft 1561 of the hockey stick 1560. If the marker does not easily move onto the blade and shaft, the toe of the hockey stick can be pushed further along the inner surface of the marker 1510 until it reaches the bottom surface of the marker, and can be manipulated further to be forced between the bottom surface of the marker 1510 and the ice on which it sits, thereby disengaging the marker from the ice. At that point, the marker may be lifted (flipped) along the blade and onto the shaft of the hockey stick 1560. A stack of two or more markers may be lifted from the ice and loaded onto the shaft of a hockey stick by the same method shown in FIGS. 13*a*-13*c*.

Figure 13D:
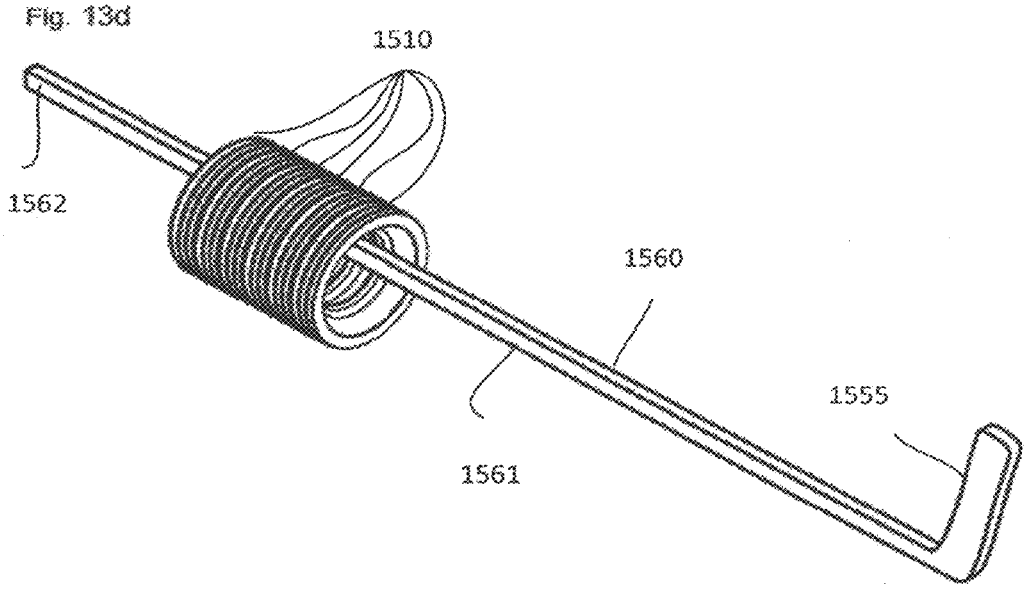
FIG. 13*d* is a perspective view of a stack of portable markers being supported by a hockey stick.
Figure 13E:
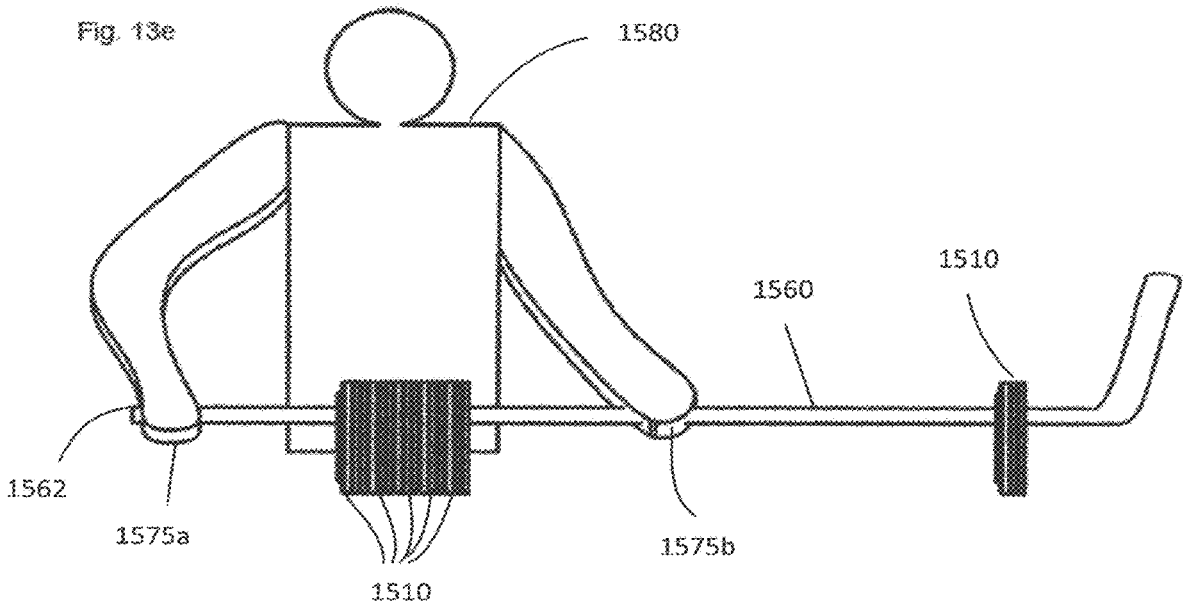
FIG. 13*e* is a diagram of a user holding a hockey stick with a stack of portable markers and a last marker having just been lifted onto the stick.

As seen in FIGS. 13*d* and 13*e*, a series or stack of markers 1510 may be carried on the shaft 1561 of the hockey stick 1560. Thus, by raising the forward blade end of the hockey stick above the handle end, the marker will slide towards the handle 1562 where it may be secured between a first hand 1575*a* of the user 1580 gripping the top end (handle) of the shaft of the stick and the other hand 1575*b* gripping the shaft of the stick at a location forward of the marker. By moving to the respective (second, third, . . . ) locations of the markers on the ice, placing the toe of the hockey stick blade into the top openings of the respective markers, lifting (e.g., flipping) each respective marker as discussed with reference to FIGS. 13*a*-13*c*, and raising the forward end of the shaft to secure each marker between the hands as discussed above, the markers 1510 may be gathered on the shaft of the hockey stick and easily transported together. One or more markers on the shaft of the hockey stick and located between hands 1575*a* and 1575*b* may be unloaded from the shaft by moving the marker or markers to a position forward of hand 1575*b* and tilting the forward blade end of the hockey stick below the handle end. The marker or markers will slide towards the blade end where they may be deposited on the ice by torqueing the shaft of the hockey stick until the toe of the hockey stick blade points downward and the marker or markers slide off the blade. The marker may be slid into position by inserting the toe of a blade of a hockey stick through the top opening of the marker and engaging the edge or bottom surface of a top wall, or the inner wall of the marker and moving the toe of the blade laterally to a new location on the ice. Markers may also be unloaded by sliding a series or stack contained on the shaft off the handle end of the hockey stick.

Figure 14A:
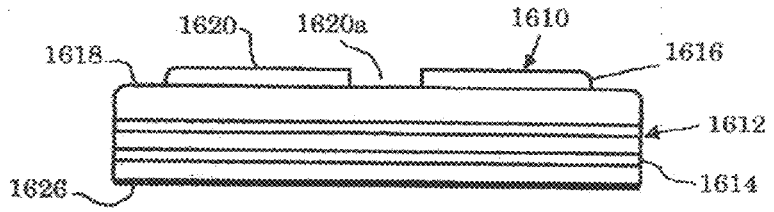
FIGS. 14*a* and 14*b* are side and top views of an embodiment of a portable marker with a stick-supporting notch.
Figure 14B:
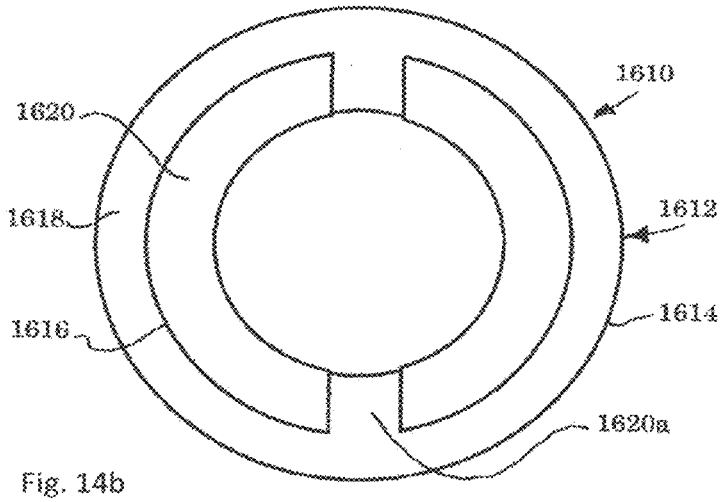

Another embodiment of a marker 1610 is seen in FIGS. 14*a* and 14*b*. Marker 1610 is substantially the same as marker 10 of FIGS. 1*a*-1*f*, or FIG. 1*g*, with a stepped peripheral wall 1612 with a generally vertical lower area 1614, a generally vertical upper area 1616, a generally horizontal shoulder 1618, a generally horizontal top surface 1620, a friction-enhanced bottom wall 1626, an inner wall (not shown), etc., except that the generally horizontal top surface 1620 defines aligned notches 1620*a*, and the horizontal shoulder 1618 extends inward at the location of the notches. In FIGS. 14*a* and 14*b*, two notches 1620*a* are provided and arranged such that a hockey stick may be laid into the notches. In other embodiments, top surface 1620 may define additional notches.

Figure 15:
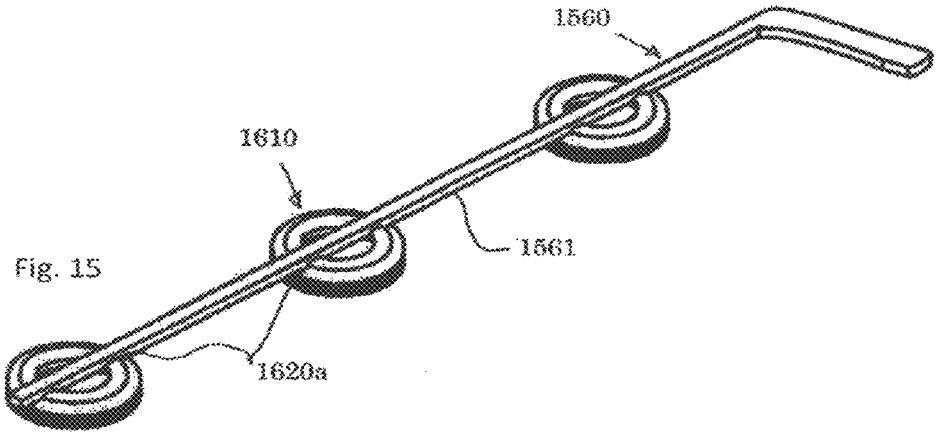
FIG. 15 is a perspective view of three portable markers of FIGS. 14*a* and 14*b* aligned with a hockey stick extending through the notches.

FIG. 15 is a perspective view of three portable markers 1610 of FIGS. 14*a* and 14*b* aligned with a shaft 1561 of a hockey stick 1560 extending through the respective notches 1620*a* of the markers. The arranged markers and suspended hockey stick shaft may be used for exercises (e.g., "stick-handling") where the puck is passed around the markers and beneath the shaft to practice on-ice stick handling maneuvers (e.g., "dangling").

Figure 16A:
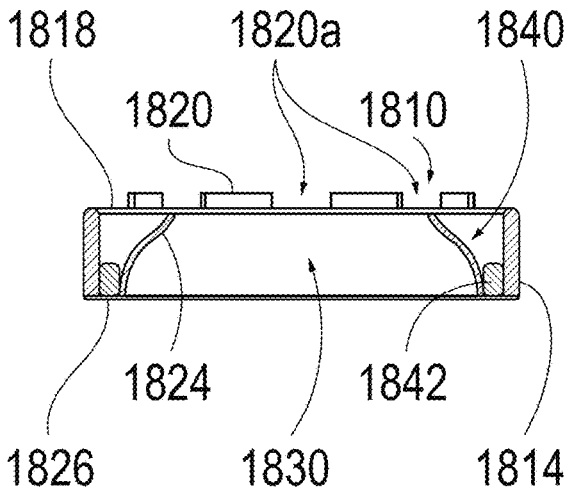
FIGS. 16*a*-16*b* are respectively a cross-sectional view, and a top view of another embodiment of a portable marker.
Figure 16B:
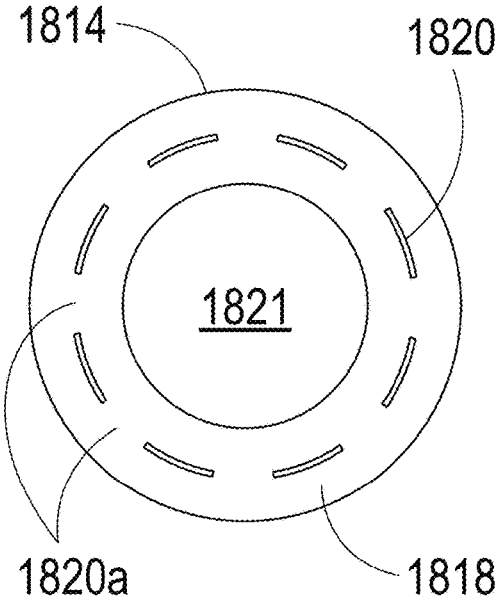
Figure 17A:
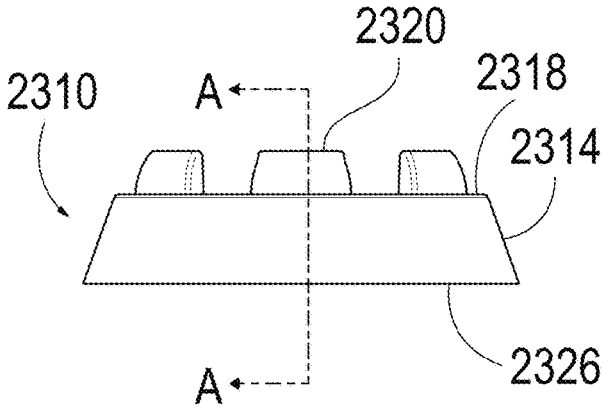
FIGS. 17*a*-17*e* are respectively a side view, a cross-sectional view, a top view, a bottom view, and a perspective view of another embodiment of a portable marker.
Figure 17B:
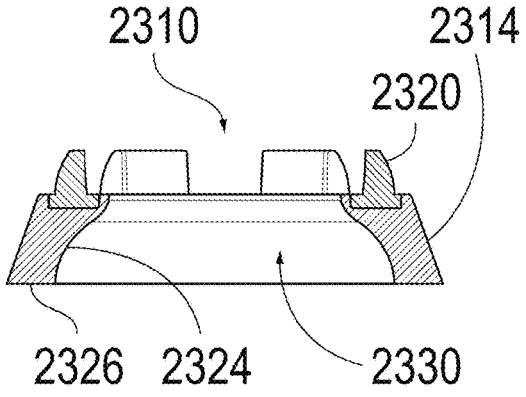
Figure 17C:
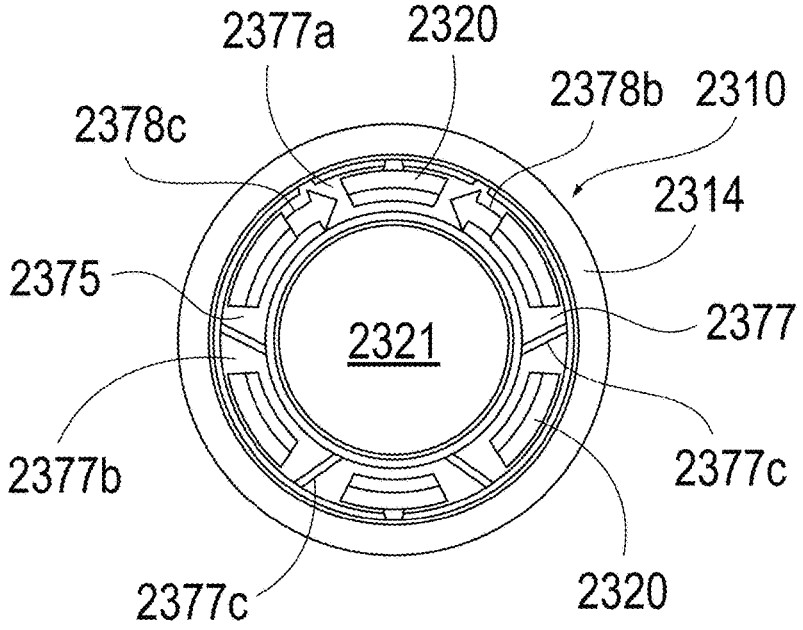
Figure 17D:
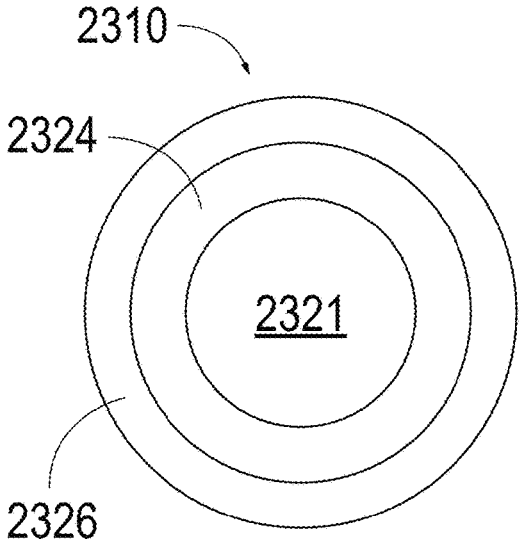
Figure 17E:
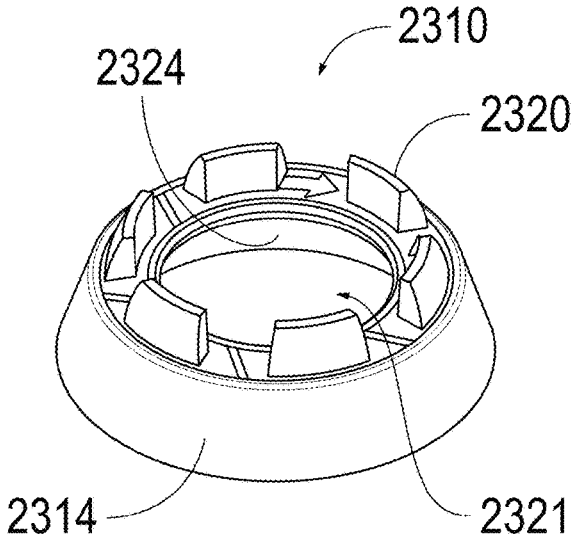

FIGS. 16*a*-16*b* show another portable marker 1810. The marker 1810 is similar in various respects to marker 10 of FIGS. 1*a*-1*f* and in many respects to marker 1610 of FIGS. 14*a*-14*b*. Marker 1810 has an outer generally vertical peripheral wall 1814, a generally horizontal shoulder 1818 defining a top opening 1821 of the marker, and a top ridge or series of extensions or protrusions 1820 that may define notches 1820*a* therebetween. As seen best in FIG. 16*a*, the marker 1810 also has an inner wall 1824 extending from the generally horizontal shoulder 1818 and spaced from the outer peripheral wall 1814. The marker 1810 further includes a bottom wall 1826 having a friction surface located between the bottom of the inner wall 1824 and the bottom of the outer peripheral wall 1814. The inner wall is shown angling in a concave fashion and defining an inner hollow 1830 that may receive the toe of a hockey stick for purposes of manipulation of the marker (as previously described). The inner hollow 1830 is shown as a modified frustoconical shape that presents a lower concave area and an upper area that is conical or slightly convex; which may also be called "plunger"-shaped. The inner wall 1824, outer wall 1814 and bottom wall 1826 together define a second hollow 1840 that are optionally provided with ballast 1842. The second hollow 1840 may be divided by interior walls into compartments for the ballast. In one aspect, the bottom wall may be shaped as a ring (disk with central hole), with a ring width similar to the width of the generally horizontal shoulder 1818 outside of top protrusions 1820 so that the portable marker 1810 may be stacked on another similar portable marker.

In one embodiment, the bottom wall 1826 is formed separately from the remainder of the portable marker and is glued, mechanically fitted or otherwise attached to the bottom surfaces of the peripheral wall 1814 and the inner wall 1824.

According to one aspect, the provided portable marker resists lateral displacement from its location on a surface such as ice having low static and dynamic coefficients of friction.

In one aspect, the provided portable marker is not easily upended from its prearranged orientation on ice.

In one aspect, the provided portable marker is easily stackable.

In one aspect, the provided portable marker is relatively light in weight and compact (relative to the markers of the prior art) and therefore easily handled and stored.

In one aspect, the provided portable marker may be separated from a stack of identical portable markers using one hand.

In one aspect, the provided portable marker may be placed upon, positioned, and removed by a user from an ice surface via the use of a hockey stick while maintaining an erect posture.

In one aspect, the provided portable marker or a stack of two or more markers may be quickly and easily placed upon and removed from an ice surface by inserting the toe of a hockey stick blade through a central opening in the marker and employing principles of leverage to respectively unload or gather the marker or stack of markers from or onto the shaft of the hockey stick.

According to another embodiment, a portable marker may be made of a foam, such as EVA, urethane, latex, or other suitable material upper portion with a central opening for receiving a hockey stick as described above with reference to the other embodiments, and a weighted base having enhanced friction qualities, with the foam upper portion and base being shaped so that the marker is stackable such that a group of six portable markers may be carried on a hockey stick as previously described. The weight of the base, and the enhanced friction aspects of the base are chosen so that the marker will not be laterally displaced when located on ice and subjected to an external force of 2 newtons applied along a horizontal radial axis towards the center of the marker, halfway up the outer peripheral wall at the corresponding point of tangency.

Figure 18A:
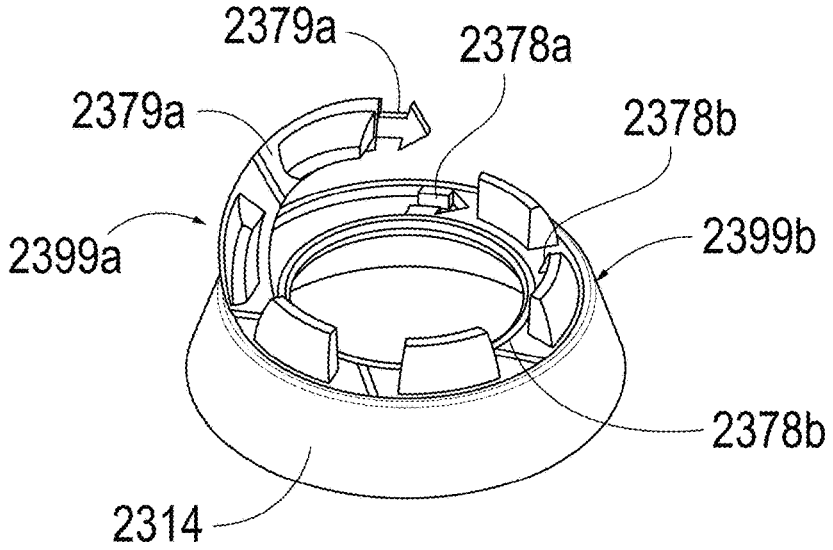
FIGS. 18*a*-18*c* are respectively a top perspective view, a side view, and a top view of the portable marker of FIGS. 17*a*-17*e* with a portion of the insert lifted.
Figure 18B:
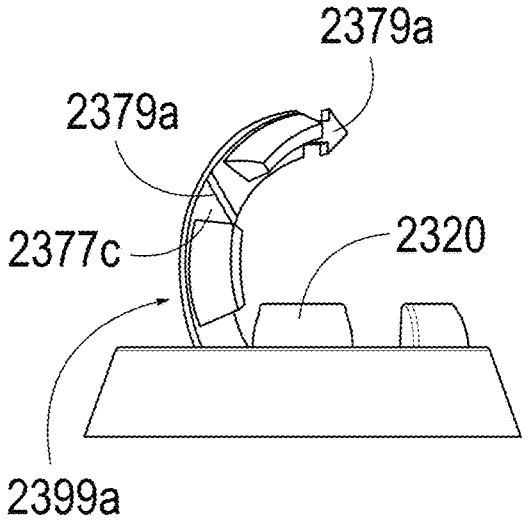
Figure 18C:
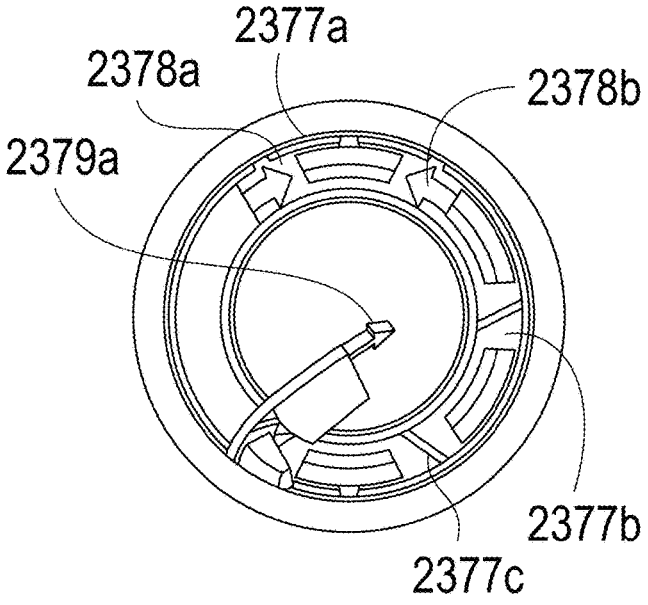
Figure 19B:
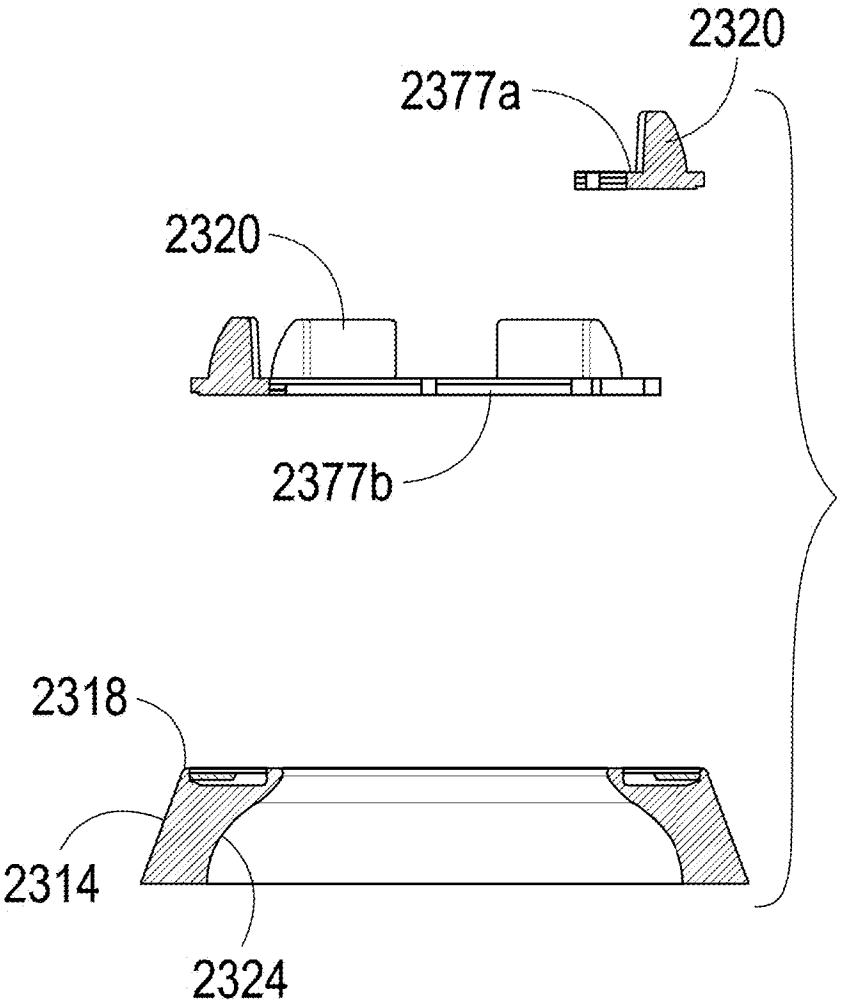
FIGS. 19*a*-19*c* are respectively an exploded side view, an exploded cross-sectional view, and an exploded assembly view of the portable marker of FIGS. 17*a*-17*e* with a portion of the insert lifted.
Figure 19A:
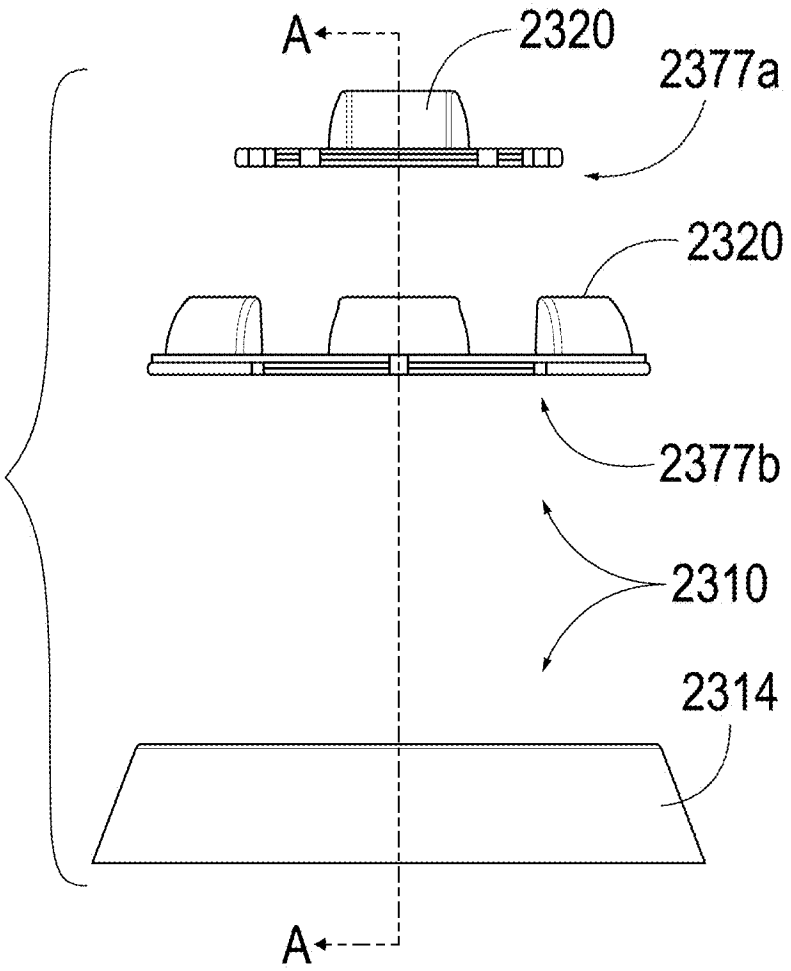
Figure 19C:
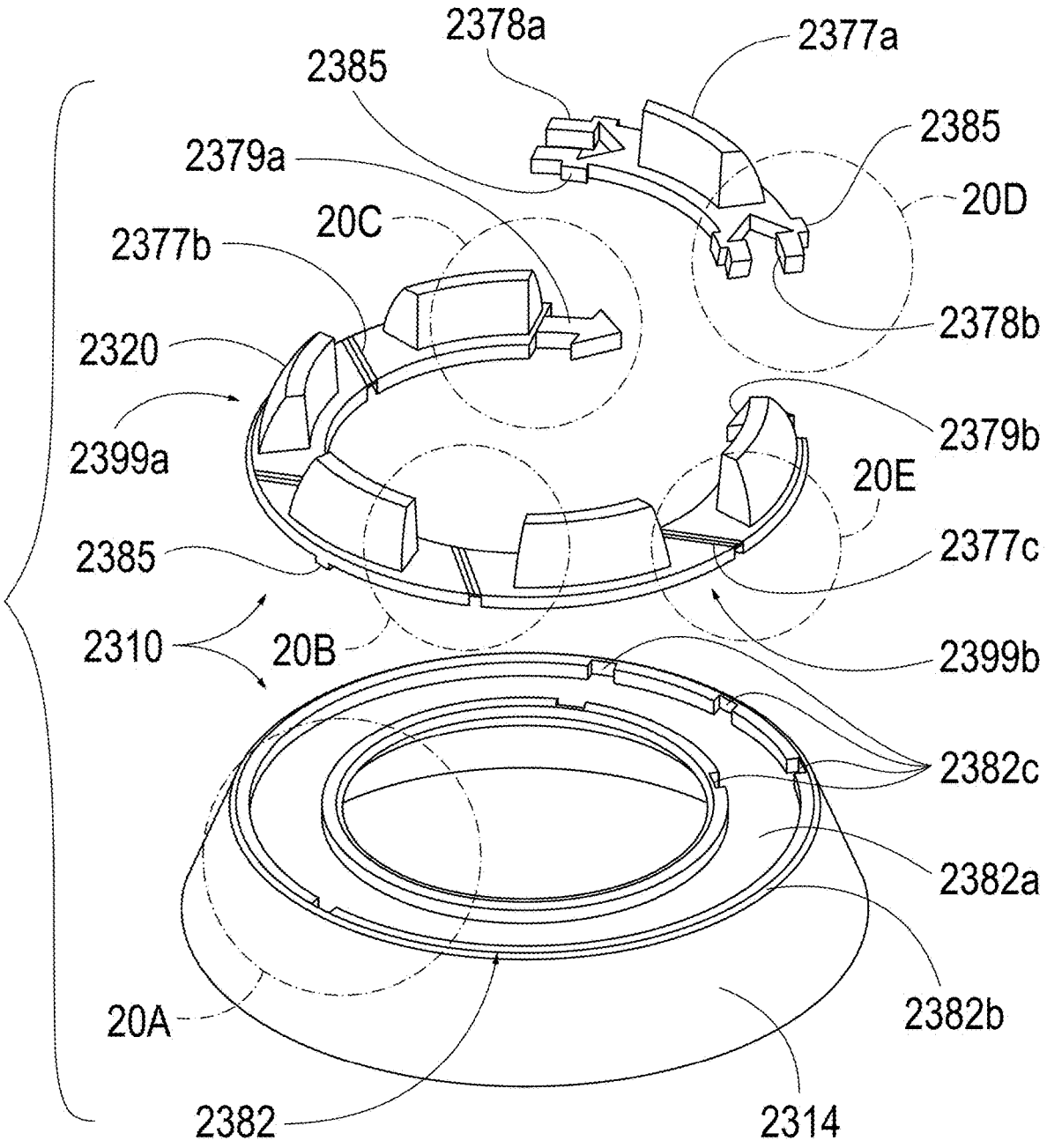

FIGS. 17*a*-17*e*, 18*a*-18*c*, FIGS. 19*a*-19*c*, and FIGS. 20*a*-20*e* provide details of yet another embodiment of a portable marker 2310, where FIGS. 17*a*-17*e* are respectively a side view, a cross-sectional view, a top view, a bottom view, and a perspective view of marker 2310, FIGS. 18*a*-18*c* are respectively a top perspective view, a side view, and a top view of marker 2310 with a portion of an insert 2375 lifted, FIGS. 19*a*-19*c* are respectively an exploded side view, an exploded cross-sectional view, and an exploded perspective view of the marker of 2310, and FIGS. 20*a*-20*e* are detailed views of FIG. 19*c*. Marker 2310 is comprised of a durable, water-resistant material, able to withstand sub-freezing temperatures and includes a substantially vertical outer wall 2314, an inner wall, 2324, a top surface or shoulder 2318 extending from the outer wall to the inner wall, a bottom friction surface 2326 extending from the bottom of the inner wall to the bottom of the outer wall, and an insert 2375 including at least a portion of a ring and having upper wall elements 2320 extending upward therefrom. The inner wall 2324 defines an inner hollow 2330 that may receive the toe of a hockey stick for purposes of manipulation of the marker (as previously described). The inner hollow 2330 is shown as a modified frustoconical shape that presents a lower concave area and an upper area that is conical or slightly convex; which may also be called "plunger"-shaped. The lower portion of the marker 2310 including the inner and outer walls may be solid (as shown), or may form a second hollow between the inner and outer walls as previously described, which may be provided with ballast as previously described. Also, a circumferential ballast may be added to the bottom of the lower portion of the marker 2310 as described with respect to the embodiments shown in FIGS. 21*a*, 22, 23, and 26*d*.

As best seen in FIGS. 19*a*, 19*b*, and 19*c*, the insert 2375 includes a two-part ring 2377 with a smaller part 2377*a* and a larger part 2377*b*, and with the larger part 2377*b* having one or more living hinges 2377*c* defined therein, and with upper wall elements 2320 extending upward from both parts of the ring 2377. In addition, as shown best in FIGS. 17*c*, 18*a*, 18*c*, 19*c*, and 20*d*, part 2377*a* of the ring defines arcuate cuts 2378*a*, 2378*b* on either side of an upper wall element 2320 which are in the shape of an arrow head, and part 2377*b* of the ring includes two arrow-heads 2379*a*, 2379*b* on either end of part 2377*b* that are generally directed toward each other. Adjacent the cuts 2378*a*, 2378*b*, the ring part 2377*a* includes locking elements 2378*c* (FIG. 20*d*) with a larger base 2378*d* helping define a flat ledge 2378*e*.

Figure 20A:
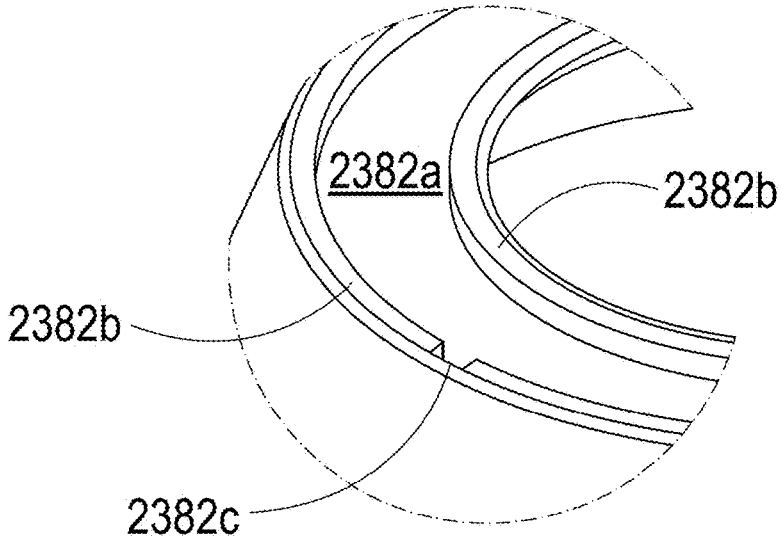
FIGS. 20*a*-20*e* are detailed views of the marker shown in FIG. 19*c*.

As seen best in FIGS. 19*c* and 20*a*, the top wall 2318 (FIG. 19*b*) or shoulder of marker 2310 defines a receiving area 2382 for the ring 2377. Receiving area 2382 has a bottom surface 2382*a*, and rims 2382*b* defining notches 2382*c*. The receiving area 2382 receives and engages the ring 2377 of the insert 2375 such that the ring portion 2377 and the receiving area 2382 have a snap fit engagement (with rims 2382*b* sitting above the flat ring 2377). Ring portion 2377*a* is shown with nubs or protrusion 2385 that align with notches 2382*c* in the rims such that the smaller ring portion 2377*a* is fixed in a specific location in the receiving area 2382. When ring portion 2377*a* is pushed into the receiving area 2382, the ring portion 2377*a* will force the rims 2382*b* to deform between notches 2382*c* so that the ring portion 2377*a* can snap into place. However, because the ring portion 2377*a* includes locking elements 2378*c* with flat ledges 2378*e*, the ring portion 2377*a* should be fixed in place with locking elements 2378*c* located beneath a flat underside surface of the corresponding portion of rim 2382*b*.

Figure 20B:
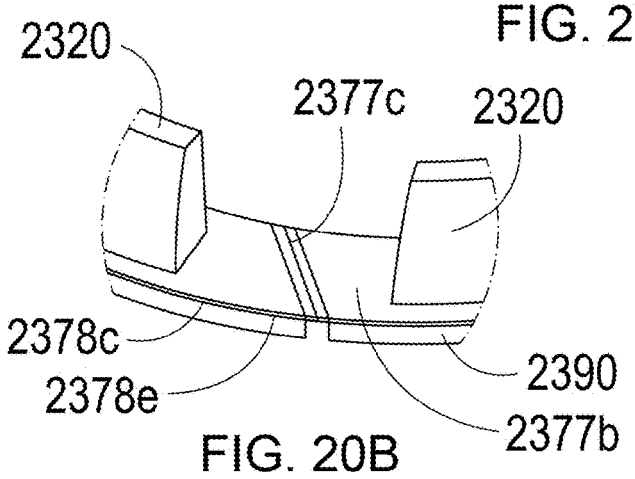
Figure 20C:
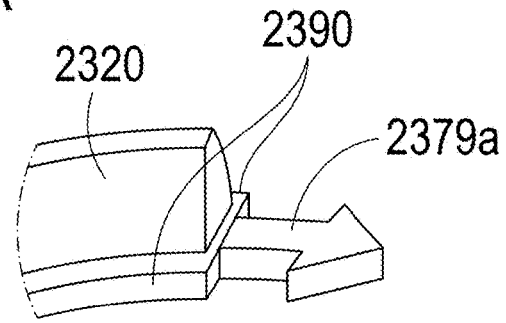
Figure 20D:
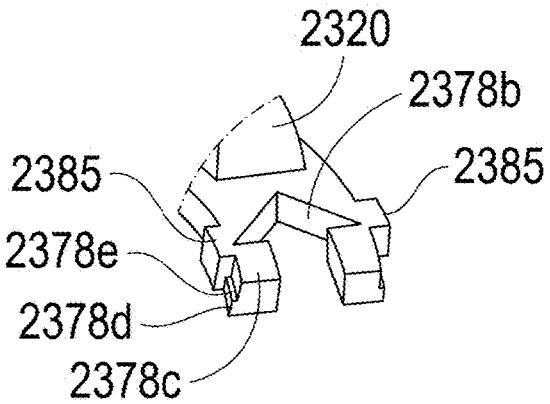
Figure 20E:
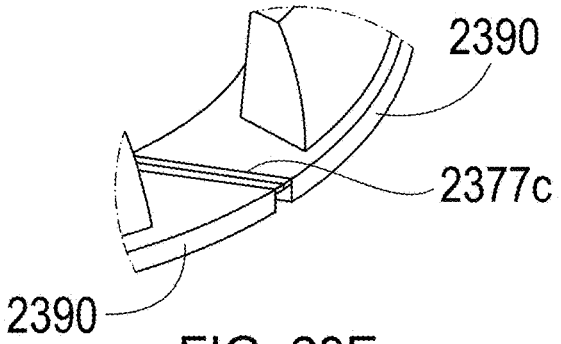

As seen best in FIG. 19*c*, FIG. 20*a* and FIG. 20*b*, ring portion 2377*b* also includes a nub or protrusion 2385 that is intended to align with a notch 2382*c* in a rim 2382*b* located at an upper wall element 2320 marked B in FIG. 19*c*. Adjacent the protrusion, ring portion 2377*b* includes a locking element 2378*c* having a flat ledge 2378*e* which acts to lock a middle portion of ring portion 2377*b* in place across from ring portion 2377*a*. However, ring portion 2377*b* extends around an arc of about 280°, and except for the middle locking portion presents rounded rims 2390 (on both the inner and outer sides) that may push past rims 2382*b* of upper surface 2318 and be held in place. Because rims 2390 are rounded, they may be more easily extracted from the rounded underside surface of corresponding portions of rims 2382*b*. It is also noted that ring portion 2377*b* includes a plurality of living hinges 2377*c*. With the provided arrangement, ring portion 2377*b* may be considered to include a fixed area at upper wall element 2320 marked B and two arm portions 2399*a*, 2399*b* extending from living hinges 2377*c* surrounding respective sides of upper wall element 2320 (marked B). It is possible to lift arms 2399*a*, 2399*b* from any of the living hinge locations above the rims 2382*b* as seen in FIGS. 18*a*-18*c* (only arm 2399*a* shown lifted) so that the arrows 2379*a*, 2379*b* extend above the top surface 2318 and point in their respective directions and are easily viewable.

The inner wall 2324 defines an inner hollow 2330 that may receive the toe of a hockey stick for purposes of manipulation of the marker. The inner wall and outer wall may be the inner and outer walls of a solid frustoconical or tapered body, or may be spaced from each other to define a second hollow that may be provided with ballast as described above with respect to other embodiments. The portable marker 2310 may be stacked on another portable marker 2310.

In embodiments, the insert 2375, or a portion thereof, may be transparent to serve as a window covering text or graphics (not shown) inserted beneath the insert 2375 and on top of the top wall 2318. Generally, the arrows 2379*c*, 2379*d* and a portion of arms 2399*a*, 2399*b* adjacent the arrows will be visible and not be transparent so that they may serve to direct skaters (or others partaking in sporting activities if the marker 2310 is used for other sports such as field-hockey, lacrosse, soccer, etc.) If desired, one of the arms may be colored red and the other colored green for directing activities in one direction or another. Accordingly, generally, the insert 2375 may be comprise two or more pieces of different colors or designs to serve as directional or instructional indicators.

Figure 21A:
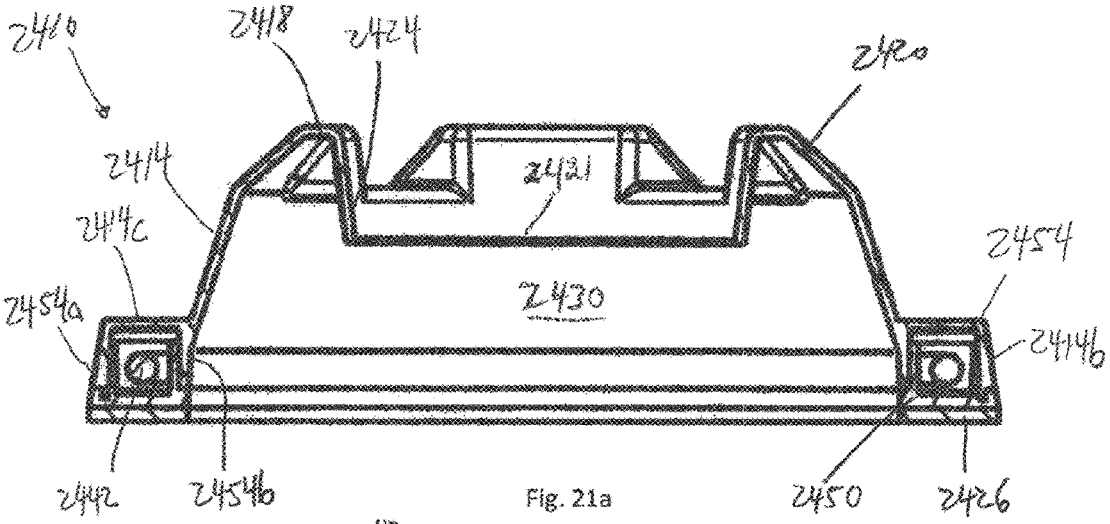
FIGS. 21*a*-21*c* are respectively a cross-sectional view, a top perspective view, and a bottom perspective view of another embodiment of a portable marker.
Figure 21B:
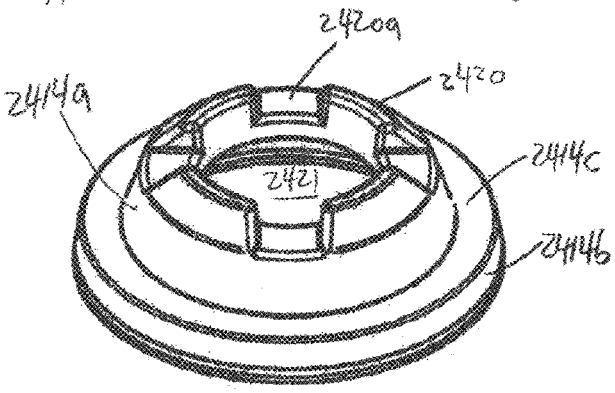
Figure 21C:
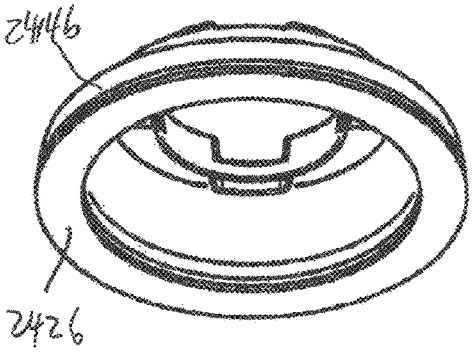

FIGS. 21*a*-21*c* provide details of yet another embodiment of a portable marker 2410, where FIGS. 21*a*-21*c* are respectively a cross-sectional view, a top perspective view, a bottom perspective view of marker 2410. Marker 2410 is comprised of a durable, water-resistant material, able to withstand sub-freezing temperatures and includes an outer wall 2414 having a generally vertical upper area 2414*a* and a generally vertical lower area 2414*b* connected to the upper area by a shoulder 2414*c*. The lower area 2414*b* includes an annular channel 2454 that is configured to house ballast 2442, as described in greater detail hereinbelow. The annular channel 2454 is defined by an outer peripheral surface 2454*a*, an inner surface 2454*b* having a smaller diameter than the outer peripheral surface 2454*a*, and the shoulder 2414*c* extending between the outer peripheral surface 2454*a* and the inner surface 2454*b*. In the embodiment, the outer peripheral surface 2454*a*, inner surface 2454*b*, and the shoulder 2414*c* are unitary with the outer wall 2414.

The upper area 2414*a* of the outer wall 2414 defines a plurality of circumferentially spaced wall elements 2420. The wall elements 2420 define notches 2420*a* therebetween that are configured to receive the shaft of a hockey stick.

The marker 2410 is also comprised of a bottom friction surface 2426 coupled to the bottom of the lower area 2414*b* of the outer wall 2414. In the embodiment shown in FIG. 21*a*, the friction surface 2426 is coupled to the lower area 2414*b* of the outer wall 2414 via an annular ballast channel 2450, which is received into and secured to the annular channel 2454 formed in the lower area 2414*b* of the outer wall 2414. The ballast channel 2450 and the annular channel 2454 may be configured to securely connect in various ways, including a press fit, a snap fit, a thread fit, a weld, or with glue.

The marker 2410 is also comprised of an inner wall 2424 and a top surface of shoulder 2418 extending from the upper area 2414*a* of the outer wall 24141 to the inner wall 2424. The inner wall 2424 is circumferentially spaced from an inner surface of the outer wall 2414. The inner wall 2424 defines a central opening 2421 and an inner hollow 2430 that may receive the toe of a hockey stick for purposes of manipulation of the marker (as previously described).

Figure 22:
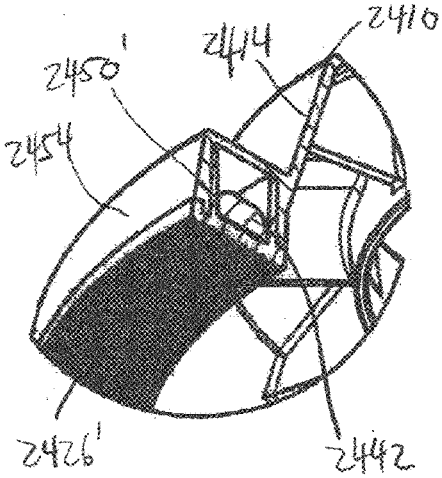
FIG. 22 is a detailed cross-sectional view of another embodiment of a portable marker with a ballast channel integrally molded with an abrasive surface.
Figure 23:
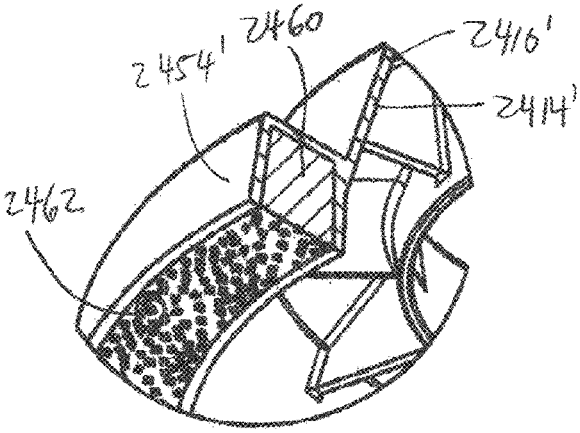
FIG. 23 is a detailed cross-sectional view of another embodiment of a portable marker.

FIGS. 22 and 23 show alternate embodiments of the marker 2410. In FIG. 22, a portion of the outer shell 2414 of marker 2410 is shown connected to a modified ballast channel 2450' having a friction surface 2426' that is integrally formed into a bottom wall of the channel 2450'. For example, the friction surface 2426' may be molded with the channel 2450'. In FIG. 23 an alternate marker 2410' has a modified outer shell 2414' that has an annular channel 2454' filled with a material 2460 having a lower or bottom surface that contains embedded granules 2462. The material 2460 may be formed from a liquid that hardens or otherwise cures in the annular channel 2454' or in a mold. The granules may comprise a high friction material such as silicon carbide, aluminum oxide, allyl diglycol carbonate or other suitable materials and can be placed or set onto the surface of the liquid so that the granules are embedded into the surface to provide a rough, high friction surface texture to resist sliding on ice.

FIG. 24*a* is a top perspective view of another embodiment of a portable marker 2510, which is substantially the same as marker 2410, but is modified as described hereinbelow. In FIGS. 24*a*-24*c* and 25*a*-25*c*, elements corresponding to marker 2410 are incremented by "100". The marker 2510 includes one or more different means for securing an elevated shaft of a hockey stick within opposed pairs of upper area notches 2520*a*', 2520*a*", 2520*a*'", and 2520*a*"". While four different securing means are shown, it is noted that any or all of the securing means may be the same or different. FIG. 24*a* show a shaft of a hockey stick secured within a first notch 2520*a*' and a second notch 2520*a*". An elastic strap 2570 extends across the first notch 2520*a*' and a moveable (slidable in a vertical direction), inelastic strap 2572 extends across the second notch 2520*a*", which is diametrically opposite the first notch 2520*a*'. As shown in greater detail in FIG. 24*c*, the elastic strap 2570 extends from circumferentially spaced wall elements 2520 defining the first notch 2520*a*'. Also, the slidable strap 2572 extends from circumferentially spaced wall elements 2520 defining the second notch 2520*a*". In embodiments, the slidable strap 2572 may be spring biased to clamp down on the shaft of the hockey stick disposed between the slidable strap and the second notch.

FIGS. 25*a*-25*c* show the hockey stick disposed in a third notch 2520*a*'" and a fourth notch 2520*a*"". The third notch 2520*a*'" includes an elastic, flexible liner 2574 that lines the third notch 2520*a*'" and is configured to compress against and grip the outer surface of the shaft of the hockey stick to prevent the shaft from coming out of the third notch 2520*a*'". The liner 2574 may be formed from a high friction material such as rubber. The fourth notch 2520*a*"" includes gripping protrusions 2576 that extend circumferentially from the sidewalls of the wall elements 2520 that define the fourth notch 2520*a*"". The protrusions 2576 may be formed of high friction material, such as rubber, or they may be integrally molded into the notch-side walls of elements 2520.

Figure 26A:
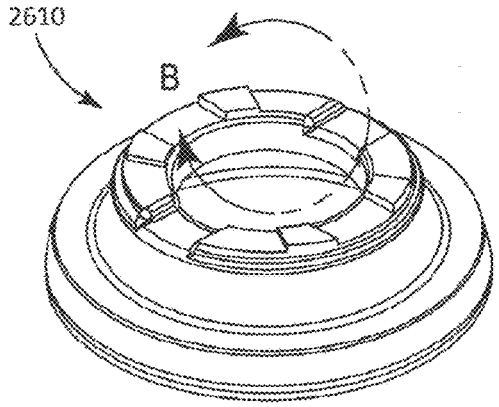
FIGS. 26*a* and 26*b* are respectively a top perspective view and a detail view of another embodiment of a portable marker with shallow upper area notches and straps for securing a shaft.
Figure 26B:
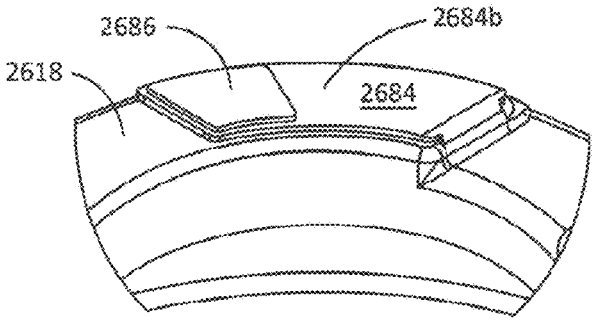
Figure 26C:
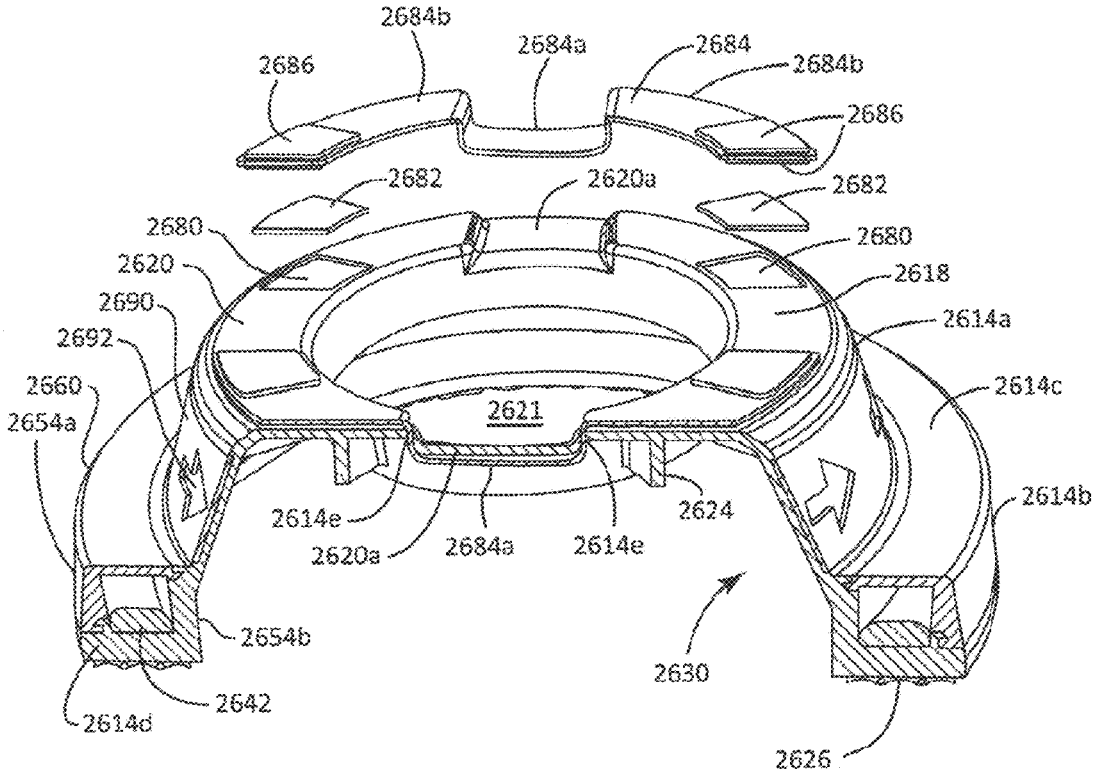
FIG. 26*c* is a partial cut-away top perspective view of the portable marker shown in FIGS. 26*a* and 26*b*.

FIGS. 26*a* and 26*b* are respectively a top perspective view and a detail view of another embodiment of a portable marker 2610 with shallow upper area notches and straps for securing a shaft. FIG. 26*c* is a sectional assembly view of the portable marker shown in FIGS. 26*a* and 26*b*. In FIGS. 26*a*-26*c* elements corresponding to those of marker 2410 are shown incremented by "200".

Marker 2610 is comprised of a durable, water-resistant material, able to withstand sub-freezing temperatures and includes an outer wall 2614 having a generally vertical upper area 2614*a* and a generally vertical lower area 2614*b* connected to the upper area by generally horizontal shoulder 2614*c*. The lower area 2414*b* defines an annular channel 2654 that is configured to house ballast 2642, as described in greater detail hereinbelow. The annular channel 2654 is defined by an outer peripheral surface 2654*a*, an inner surface 2654*b* having a smaller diameter than the outer peripheral surface 2654*a*, the shoulder 2614*c*, and an bottom annular surface 2614*d* of the lower area 2614*b*. The marker 2610 also includes a bottom friction surface 2626 coupled to the bottom surface 2614*d*. The outer peripheral surface 2654*a* and the shoulder 2614*c* are integrally formed as a snap fit ring 2660 having an L-shaped profile. The inner surface 2654*b* of the annular channel 2654 and the bottom surface 2614*d* are integrally formed and have snap fit connectors that are configured to snap together with mating snap fit connectors of the ring 2660 to enclose the ballast 2642.

Figure 26D:
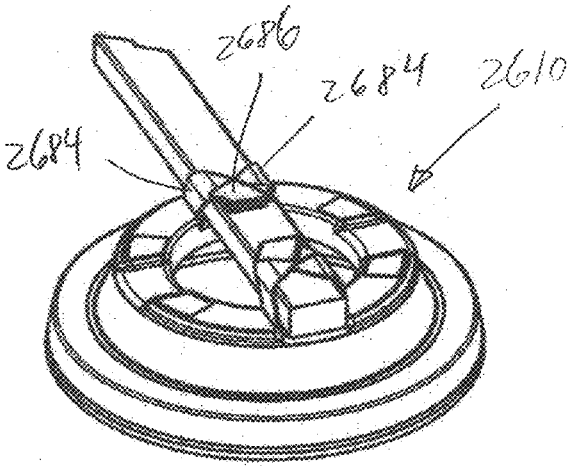
FIG. 26*d* is a top perspective view of the portable marker of FIGS. 26*a*-26*c* with a shaft secured to notches by straps.

The upper area 2614*a* of the outer wall 2614 defines a plurality of circumferentially spaced wall elements 2620. The wall elements 2620 define notches 2620*a* therebetween that are configured to receive the shaft of a hockey stick. Also, the upper area 2614*a* defines a plurality of shallow recesses 2680 that are configured to receive hook and loop fasteners 2682. The corners of each notch 2620*a* define radial slots 2614*e* through the outer wall 2614. The marker 2610 includes a strap 2684 having a central portion 2684*a* and side flaps 2684*b* that extend from the central portion 2684*a*. The strap 2684 is connected to the outer shell 2614 by disposing the central portion 2684*a* under the notch 2620*a* and routing the flaps 2684*b* through the slots 2614*e*. Each flap 2684*b* has a hook and loop fastener 2686 attached to opposite sides of the flap 2684*b*, which is configured to align with and attach to the hook and loop fasteners 2682. FIGS. 26*a* and 26*b* show the straps in a first open position lying flat. FIG. 26*d* shows the straps in a second configuration in which the flaps are connected together by their hook and loop fasteners around a shaft of a hockey stick disposed in diametrically opposed notches 2620*a*.

The marker 2610 is also comprised of an inner wall 2624 and a top surface of shoulder 2618 extending from the upper area 2614*a* of the outer wall 2614 to the inner wall 2624. The inner wall 2624 is circumferentially spaced from an inner surface of the outer wall 2614. The inner wall 2624 defines a central opening 2621 and an inner hollow 2630 that may receive the toe of a hockey stick for purposes of manipulation of the marker (as previously described).

Figure 26E:
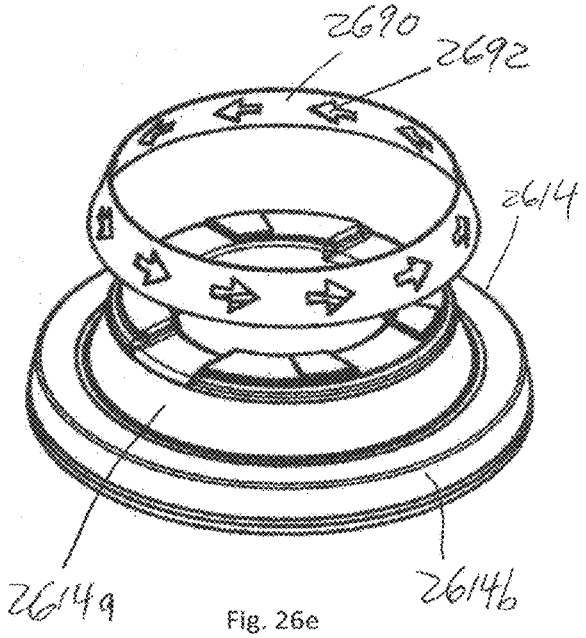
FIG. 26*e* is a top perspective view of the portable marker of FIGS. 26*a*-26*d* with a removable directional collar shown partially in FIG. 26*d*.

FIGS. 26*c* and 26*e* show an optional removable directional collar 2690 that is shown attached to the marker 2610. The collar 2690 is shown attached to the upper portion 2614*a* of the outer wall 2614. In the example shown, the collar 2690 is seated on a frustoconical surface of the upper portion 2614*a* of the outer wall 2614. The collar 2690 may have cutouts in the shape of arrows, as shown in FIGS. 26*c* and 26*e* so that when the collar 2690 is attached to the marker 2610, the color of the underlying outer wall 2614 is visible. Preferably, the color of the collar 2690 is distinguishable from the color of the outer wall 2614 so that the arrows are visible. Alternatively, the collar may be a solid flexible ring that is printed, painted, or otherwise bears directional markings, such as arrows. The collar 2690 is flexible so that it can be inverted inside out to change the directionality of the markings on the marker 2610.

As an alternative to the flexible removable collar 2690 described above with fixed indicia or markings, another collar may be attached in place of the flexible collar that has a dry-erase or other erasable writing or marking surface. A user can write and re-write directional or any other markings on the writing surface with erasable dry-erase markers.

In embodiments, any of the markers described herein may include magnets or other couplers to couple the markers to other structures, such as a steel frame of hockey goal above the ice surface. Such positioning can permit the markers to be used for hockey target practice, either presenting locations at which a puck should be aimed (e.g., a top corner of the goal post), or presenting locations where a hockey goalie or defenseman is expected to block a shot (e.g., at the foot of the goal). For example, in one embodiment, magnets may be located in a lower area of the peripheral wall of a portable marker and such magnets may be coupled to the steel frame of a hockey goal at locations above the ice surface. In other embodiments the peripheral wall may be provided with hook and loop fastener elements (e.g., VELCRO®—a trademark of Velcro BVBA). Thus, buttons or strips of hook fasteners could be located at one, two, or more locations around the periphery of the lower area of the outer wall, and buttons or strips of loop fasteners could be located at one, two, or more locations around the periphery of the lower area of the outer wall so that the hook fasteners or loop fasteners of one marker could engage the loop fasteners or hook fasteners another marker.

There have been described and illustrated herein several embodiments of a portable marker and a method of its use. While particular embodiments have been described, it is not intended that the invention be limited thereto, as it is intended that the invention be as broad in scope as the art will allow and that the specification be read likewise. Thus, while particular materials have been disclosed, it will be appreciated that other materials may be used as well. Also, while portable markers having a round cross-section were described, it will be appreciated that the markers could be octagonal, square, or of other cross-section. Accordingly, the term "circumference" as used herein is to be understood broadly to refer to the periphery of the marker, such that the circumference of a square marker would be equal to four times the measure of one side. It will therefore be appreciated by those skilled in the art that yet other modifications could be made to the provided invention without deviating from its spirit and scope as claimed.

What is claimed is:

1. A portable marker for use on ice in conjunction with at least one hockey stick, comprising:

a base portion having a bottom contact surface configured to interface to the ice, wherein the base portion defines a bottom central opening; and an outer wall extending upward from the base portion to a top portion, wherein the top portion defines a top central opening, wherein both the bottom central opening and top central opening lead into a hollow space surrounded by the outer wall, wherein the top opening is configured to receive a toe of the blade of hockey stick for insertion into the hollow space, wherein the top portion further defines a plurality of notches that are spaced about the top central opening and face upward, wherein each notch is configured to receive at least part of a shaft of the hockey stick, and wherein the top portion supports a plurality of straps that extends across the plurality of notches, wherein each strap is configured to secure the shaft of the hockey stick disposed within a corresponding notch to the portable marker.

2. A method utilizing a hockey stick having a blade, a shaft and a handle, comprising: moving the portable marker according to claim 1 from a location along the shaft of the hockey stick suspended above an ice surface by lowering the blade end of the hockey stick below the handle end causing the portable marker to slide towards the blade end and applying torque to the shaft of the hockey stick until the toe of the hockey stick blade points downward allowing the portable marker to slide off the blade of the hockey stick and onto the ice surface.

3. The portable marker according to claim 1, wherein:

the top central opening has at least one dimension of 2.5 inches or more.

4. The portable marker according to claim 1, wherein:

the plurality of straps comprise at least one elastic strap.

5. The portable marker according to claim 1, wherein:

the plurality of straps comprise at least one inelastic strap.

6. The portable marker according to claim 1, further comprising:

energy-absorbing ballast integral to the portable marker.

7. The portable marker according to claim 1, wherein:

the plurality of notches are arranged to receive at part of a shaft of the hockey stick that extends across a pair of notches.

8. The portable marker according to claim 1, wherein:

the outer wall is configured such that multiple portable markers are stackable one on top of the other.

9. The portable marker according to claim 1, wherein:

the bottom surface is configured to provide a friction interface to the ice, wherein the friction interface comprises at least one of abrasive coating, an abrasive sheet, a safety tread, a traction-enhanced rubber, a metal mesh, a perforated sheet, and a textile, a material in the form of at least one of points, pyramids, and inverted hollow cones, a blade or edge extending circumferentially, a plurality of blades, and a series of edges.

10. The portable marker according to claim 1, wherein:

the bottom surface is configured to provide a friction interface to the ice, wherein the friction interface is configured such that said portable marker will not be laterally displaced when located on the ice and subjected to an external force of 2 Newtons applied along a horizontal radial axis towards the center of the portable marker, halfway up the outer wall at the corresponding point of tangency.

11. The portable marker according to claim 1, wherein:

the portable marker weighs between 0.75 and 2 pounds.

12. The portable marker according to claim 1, wherein:

the portable marker is between 1 and 8 inches tall.

13. A method comprising:

removing a plurality of portable markers according to claim 1 from an ice surface by placing the toe of a hockey stick blade through the top central opening in a first portable marker and causing the first portable marker to move onto a shaft of a hockey stick;

raising the blade end of the hockey stick above the handle end causing the first portable marker to slide towards the handle end where the first portable marker is secured by gripping the handle end of the shaft of the hockey stick and by gripping the shaft of the hockey stick at a location forward of the first portable marker.

14. The method of claim 13, further comprising:

moving to the location of a second portable marker with the first portable marker secured on the shaft of the hockey stick;

placing the toe of the hockey stick blade through the top central opening in the second portable marker and causing the second portable marker to move onto the shaft of the hockey stick; and raising the blade end of the hockey stick above the handle end causing the second portable marker to slide towards the handle end where the second portable marker is secured adjacent the first portable marker.

* * * * *